US006546684B2

(12) United States Patent
Waalkes et al.

(10) Patent No.: US 6,546,684 B2
(45) **Date of Patent: *Apr. 15, 2003**

(54) PARTITION PANEL

(75) Inventors: Michael L. Waalkes, Athens, AL (US); Marcus K. Pressnell, Athens, AL (US); Mark T. Slager, Kentwood, MI (US); Michael R. Shields, Greensboro, NC (US); Brian J. Kane, San Francisco, CA (US); Robin Christopher, Athens, AL (US); Dennis J. Boyle, Palo Alto, CA (US); Peter N. Skillman, San Carlos, CA (US); Charles A. Seiber, Atherton, CA (US); Joseph Chang, Grand Rapids, MI (US); Richard S. Hand, Holland, MI (US); Douglas L. Scheerhorn, Byron Center, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/827,153

(22) Filed: Apr. 5, 2001

(65) Prior Publication Data

US 2002/0029529 A1 Mar. 14, 2002

Related U.S. Application Data

(60) Continuation of application No. 09/558,753, filed on Apr. 21, 2000, now Pat. No. 6,276,103, which is a division of application No. 09/060,913, filed on Apr. 15, 1998, now Pat. No. 6,098,358.

(51) Int. Cl.[7] ..... E04B 2/74

(52) U.S. Cl. ..... 52/239

(58) Field of Search ..... 52/239, 481.2, 52/775

(56) References Cited

U.S. PATENT DOCUMENTS

| | | | |
|---|---|---|---|
| 2,218,426 | A | 10/1940 | Hurlbert, Jr. |
| D127,967 | S | 7/1941 | Meyer |
| 2,430,654 | A | 11/1947 | Voege |
| 2,963,127 | A | 12/1960 | Manville |
| 3,209,869 | A | 10/1965 | Hammitt |

(List continued on next page.)

FOREIGN PATENT DOCUMENTS

| | | |
|---|---|---|
| DE | 3726255 A1 | 1/1989 |
| EP | 50241 | 4/1982 |
| EP | 0138658 | 4/1982 |
| EP | 200514 A1 | 11/1996 |

OTHER PUBLICATIONS

Wireworks™ Panel System, Krueger International, Inc., 1998.

*Primary Examiner*—Laura A. Callo
(74) *Attorney, Agent, or Firm*—Price, Heneveld, Cooper, DeWitt & Litton

(57) ABSTRACT

A knock-down partition panel frame includes a pair of spaced apart generally upright posts, each having at least one receptacle defining a tapered surface. The partition panel frame further includes at least one generally horizontal member extending between and interconnecting the posts. The horizontal member includes fastenerless connectors at opposite ends thereof, each having at least one connecting element engaging with the tapered surface to thereby securely interconnect the posts and the horizontal member to define a rigid partition frame having an interior space. A cover panel is secured to the partition frame, and closes off at least a portion of the interior space.

29 Claims, 23 Drawing Sheets

U.S. PATENT DOCUMENTS 3,462,892 A 8/1969 Meyer
3,492,766 A 2/1970 Andrews
3,517,623 A * 6/1970 Goldstein et al. ..... 248/243 X
3,567,260 A 3/1971 Norris
3,601,432 A 8/1971 Fenwick
3,638,376 A 2/1972 Howes et al.
3,697,034 A 10/1972 Shell
3,700,385 A 10/1972 Sherwood
3,713,474 A 1/1973 Orlando
3,745,732 A 7/1973 Pritchard et al.
3,749,432 A 7/1973 Janssen
3,789,567 A 2/1974 Rae et al.
3,858,988 A 1/1975 Cohen
3,886,698 A 6/1975 Raith et al.
3,888,440 A 6/1975 Rebentisch
3,971,182 A 7/1976 Donahue et al.
4,004,856 A 1/1977 Wesseler
4,018,019 A 4/1977 Raith et al.
4,048,768 A 9/1977 Good
4,123,879 A 11/1978 Blodee et al.
4,128,979 A 12/1978 Price
4,154,419 A 5/1979 Breidenbach
4,205,815 A 6/1980 Sauer et al.
4,249,578 A 2/1981 Freeman
4,265,502 A 5/1981 Blodee et al.
4,314,429 A 2/1982 Casteel et al.
4,334,374 A 6/1982 Spamer et al.
4,338,990 A 7/1982 Blodee et al.
4,356,672 A 11/1982 Beckman et al.
4,391,073 A 7/1983 Mollenkopf et al.
4,406,374 A * 9/1983 Yedor ..... 211/192
4,416,093 A 11/1983 Salkeld et al.
4,434,596 A 3/1984 McAteer et al.
4,448,231 A 5/1984 Salkeld et al.
4,470,232 A 9/1984 Condevaux et al.
4,485,597 A 12/1984 Worrallo
4,489,530 A 12/1984 Chang
4,535,577 A 8/1985 Tenser et al.
4,567,698 A 2/1986 Morrison
4,571,906 A 2/1986 Ashton
4,625,476 A 12/1986 Shimada
4,625,477 A 12/1986 Johnstonbaugh
4,631,881 A 12/1986 Charman
4,682,457 A 7/1987 Spencer
4,685,255 A 8/1987 Kelley
4,693,383 A * 9/1987 Fenwick ..... 211/192
4,716,699 A 1/1988 Crossman et al.
4,719,731 A 1/1988 Ravotti et al.
4,757,657 A 7/1988 Mitchell et al.
4,761,922 A 8/1988 Black
4,771,583 A 9/1988 Ball et al.
4,778,487 A 10/1988 Chenel
4,837,988 A 6/1989 Menchetti et al.
4,858,407 A 8/1989 Smolik
4,876,835 A 10/1989 Kelley et al.
4,914,873 A 4/1990 Newhouse
4,914,878 A 4/1990 Tamaki et al.
4,914,880 A 4/1990 Albertini
4,918,879 A 4/1990 Bodurow et al.
4,224,769 A 5/1990 Ball et al.
4,932,177 A 6/1990 Hinden
4,936,066 A 6/1990 Rütsche et al.
4,942,713 A 7/1990 Jackson
4,971,281 A 11/1990 Steinbeck
4,991,365 A 2/1991 Jackson
4,991,368 A 2/1991 Amstutz
5,033,526 A 7/1991 DeLong et al.
5,038,539 A 8/1991 Kelley et al.
5,054,255 A 10/1991 Maninfior
5,056,285 A 10/1991 Frascaroli et al.
5,062,246 A 11/1991 Sykes
5,063,715 A 11/1991 Goodman
5,065,559 A 11/1991 Zegel et al.
5,069,263 A 12/1991 Edwards
5,079,884 A 1/1992 Menchetti
5,134,826 A 8/1992 La Roche et al.
5,155,960 A 10/1992 Shaanan
5,172,530 A 12/1992 Fishel et al.
5,177,917 A 1/1993 del Castillo Von Haucke
5,207,336 A 5/1993 Tyler
5,209,035 A 5/1993 Hodges et al.
5,211,502 A 5/1993 Upham-Hill
5,214,890 A 6/1993 Levitan et al.
5,219,406 A 6/1993 Raz
5,241,796 A 9/1993 Hellwig et al.
5,274,970 A 1/1994 Roberts
5,277,005 A 1/1994 Hellwig et al.
5,287,666 A 2/1994 Frascaroli et al.
5,377,466 A 1/1995 Insalaco et al.
5,406,760 A 4/1995 Edwards
5,464,302 A 11/1995 Menchetti
5,477,971 A 12/1995 Howard
5,487,246 A 1/1996 Hodges et al.
5,491,943 A 2/1996 Vondresjs et al.
5,495,952 A 3/1996 Kainz
5,511,349 A 4/1996 Kelley et al.
5,555,689 A 9/1996 Gilmore
5,586,593 A 12/1996 Schwartz
5,600,926 A 2/1997 Ehrlich
5,606,919 A 3/1997 Fox et al.
5,634,300 A 6/1997 Huebner et al.
5,642,593 A 7/1997 Shieh
5,657,606 A 8/1997 Ressel et al.
5,657,885 A 8/1997 White et al.
5,685,121 A 11/1997 DeFrancesco et al.
5,740,650 A * 4/1998 Seiber et al. ..... 52/584.1
5,803,653 A 9/1998 Zuffetti
5,806,258 A 9/1998 Miedema et al.
D407,665 S 4/1999 Churchville
5,899,035 A 5/1999 Waalkes et al.
5,931,429 A 8/1999 Hellwig et al.
6,009,675 A 1/2000 Waalkes et al.
6,058,667 A * 5/2000 MacDonald et al. ..... 52/239
6,079,173 A 6/2000 Waalkes et al.
6,098,358 A 8/2000 Waalkes et al.
6,115,977 A 9/2000 Hornberger et al.
6,131,347 A 10/2000 Hornberger et al.
6,276,103 B1 * 8/2001 Waalkes et al. ..... 52/239

* cited by examiner

PARTITION PANEL

CROSS-REFERENCES TO RELATED APPLICATIONS

The present application is a continuation of Ser. No. 09/558,753 filed Apr. 21, 2000 U.S. Pat. No. 6,276,103, which is a division of Ser. No. 09/060,913 filed Apr. 15, 1998 U.S. Pat. No. 6,098,358. The present application is also related to commonly assigned, U.S. Pat. No. 6,009,675, entitled KNOCK-DOWN PORTABLE PARTITION SYSTEM, and U.S. Pat. No. 5,899,035, entitled KNOCK-DOWN PORTABLE PARTITION SYSTEM, and U.S. Pat. No. 6,058,667. All of the above-identified applications and patents are hereby incorporated by reference.

BACKGROUND OF THE INVENTION

The present invention relates to office partition panel systems, and in particular to a cover panel brace for partitions.

The efficient use of building floor space is an ever growing concern, particularly as building costs continue to escalate. Open office plans have been developed to reduce overall officing costs, and generally incorporate large, open floor spaces in buildings that are equipped with modular furniture systems which are readily reconfigurable to accommodate the ever changing needs of a specific user, as well as the divergent requirements of different tenants. One arrangement commonly used for furnishing open plans includes movable or portable partition panels that are detachably interconnected to partition off the open spaces into individual workstations and/or offices. Such partition panels have sufficient structural strength to receive hang-on furniture units, such as work surfaces, overhead cabinets, shelves, etc., and are generally known in the office furniture industry as "systems furniture." In addition, such partition panels have an acoustical, sound-absorbing configuration to promote a quiet, pleasant work environment.

Numerous partition panel systems have been developed for dividing office workspaces into smaller areas. Partition panel systems, like those disclosed in U.S. Pat. No. 4,996,811, utilize prefabricated rectangular partition panel members that have a unitary rigid perimeter frame formed by top, bottom, and end channels that are welded to one another. Decorative cover panels are fastened to opposite sides of the perimeter frame. Each perimeter frame member has a rectangular shape, and is fabricated and shipped as a single unit, often with the decorative cover panels pre-fastened to the frame. During installation, the prefabricated perimeter frame of each panel member is fastened to the perimeter frame of an adjacent panel member along the vertical edges thereof, either directly, or by a separate fastener post. Each partition panel member includes two height adjustable feet or glides along the bottom edge of each panel member, with one glide being located adjacent each vertical panel edge. Since there are two vertical frame members at each panel joint, this type of panel construction results in structural redundancy. In addition, since each glide must be properly adjusted for height, this configuration requires adjustment of both glides at each panel joint during assembly. Furthermore, although longer panels typically have a lower cost per unit length, longer panels are difficult to handle, which places a practical limit on the size of the partition panel member that can be shipped and installed as a prefabricated unit.

Other partition panel systems, like that disclosed in U.S. Pat. No. 5,150,554, utilize prefabricated rectangular partition panel members having a unitary perimeter frame that attaches to a post member along each vertical panel edge. Although this type of design may have a single glide at each post, each panel-to-post connection has at least two vertical structural members. Since only a single vertical member is needed to provide support and height adjustment, this type of system has redundant structure. In addition, the rectangular partition panel members are manufactured and shipped as a unit, limiting the size of the partition panel members that can be used.

Other office divider systems, like that disclosed in U.S. Pat. No. 5,406,760, utilize vertical posts and horizontal beams wherein each post attaches to an adjacent post along adjacent vertical edges. Since each post is attached directly to an adjacent post, this configuration also has redundant vertical structural members and glides.

Other office panel dividers, like that disclosed in U.S. Pat. Nos. 5,287,666 and 5,219,406, have multiple posts and beams with connector members that hold a pair of beams to adjacent posts. This arrangement has two horizontal beams in a side-by-side relationship at each height location, and also has two vertical posts attached directly together in either a back-to-back or side-by-side relationship. Thus, there is redundancy in both the post and the beam structures. In addition, connector pieces are required to attach the beams to the posts.

SUMMARY OF THE INVENTION

One aspect of the present invention is to provide a knock-down portable partition including a panel frame having a central portion. At least one cover panel covers at least a portion of the central portion of the panel frame. Connectors detachably mount the cover panel on the panel frame to facilitate assembly and removable of the cover panel on the panel frame. The panel frame includes at least two vertical posts each having an upper end, a lower end and opposite faces with at least two beam connection ports thereon positioned adjacent the upper and lower ends of the associated one of the posts. The panel frame also includes upper and lower beams extending generally horizontally between the vertical posts adjacent the upper and lower ends thereof, and interconnecting the same adjacent the connection ports. Movable lock members having a flexible extension are positioned on one of the posts and the beams adjacent the connection ports, and are movably mounted thereon for shifting between an unlocked position and a locked position. The panel frame further includes lock-engaging surfaces positioned on the other of the posts and the beams adjacent the connection ports. The lock-engaging surfaces are located thereon to engage the flexible extensions when the lock members are shifted to the locked position to rigidly yet detachably interconnect the posts and the beams for quick and complete assembly and disassembly of the knock-down portable partition.

Yet another aspect of the present invention is a portable partition system, the improvement of a knock-down frame construction including at least two vertical posts each having at least two beam connection ports positioned in a vertically spaced-apart relationship on an associated one of the posts. Upper and lower beams extend generally horizontally between the vertical posts, and interconnect the same adjacent the connection ports. Movable lock members are positioned on one of the posts and the beams adjacent the connection ports, and are movably mounted thereon for shifting between an unlocked position and a locked position. The lock members include flexible extensions. Lock-engaging surfaces are positioned on the other of the posts and the beams adjacent the connection ports, and are located thereon to engage the flexible extensions when the lock members are shifted to the locked position to rigidly yet detachably interconnect the posts and the beams for quick and complete assembly and disassembly of the knock-down portable partition.

Yet another aspect of the present invention is a partition including at least two vertical posts. The partition includes upper and lower beams having opposite ends thereof interconnecting the vertical posts to define when in an assembled condition, a rigid panel frame having a substantially open interior. The panel frame defines a vertical dimension. At least one cover panel is configured to enclose at least a portion of the open interior of the panel frame, and is removably mounted on the panel frame to readily access the open interior thereof. The cover panel defines an interior surface and a center portion spaced-apart from the posts. A cover panel brace is connected with the upper beam, and has an outer surface abutting the interior surface of the cover panel to support the cover panel adjacent the center portion to prevent flexing of the cover panel. The cover panel brace is longitudinally extensible to accommodate variations of the vertical dimension between the upper and lower beams.

Yet another aspect of the present invention is a cover panel brace including an upper member having a connector configured to detachably connect the upper member to a partition frame. The cover panel brace also includes a lower member interconnected with the upper member. The upper and lower members define a vertical length corresponding to the vertical dimension of a partition frame. The brace is adapted to extend downwardly when installed on a partition frame to support a cover panel installed over the brace and prevent flexing of a center portion thereof. The upper and lower members are longitudinally extensible to adjust the vertical length to account for variations in the vertical dimension of the partition frame.

Yet another aspect of the present invention is a panel frame member defining an inner surface and having a sidewall with a row of slots therethrough for receiving support hooks of hang-on accessory units. The panel frame member includes a flexible light seal having a base portion fixed to the inner surface adjacent at least one of the slots. The light seal includes a flap connected to the base portion and extending over the slot to block light passage through the slot. The flap flexes inwardly upon insertion of a support hook to permit installation of a hang-on accessory unit.

Yet another aspect of the present invention is a panel frame member having a sidewall defining an inner surface. The sidewall has a row of slots therethrough for receiving support hooks of hang-on accessory units. The panel frame member includes a light seal that is fixed to the inner surface, and extends over the slots and prevents light passage through the slots.

The principal objects of the present invention are to provide a knock-down, portable partition system. Accordingly, the present partition provides a versatile, easily assembled and disassembled partition having reduced complexity and fewer components. The individual components are assembled at the installation site, thereby reducing shipping costs, and allowing for larger, more economical panel sizes. The partition panel is easily and quickly assembled, and does not require separate fasteners, such as conventional nuts and bolts. The partition panels have sufficient structural strength to support hang-on accessory units, such as binder bins, shelves, and work surfaces. Utility troughs may be installed at various heights between the posts to provide for electrical and communications conduits. The utility troughs may be installed or removed after the structural beams are installed between adjacent posts. Each post has a single adjustable foot, and a vertical row of slots for support of hang-on accessory units. Cover panels are installed to close off the open interior of the panel. Two adjacent cover panels are attached to a single post at each in-line panel joint.

These and other features, objects and advantages of the present invention will become apparent upon reading the following description thereof together with reference to the accompanying drawings.

DETAILED DESCRIPTION OF PREFERRED EMBODIMENT

Figure 1:
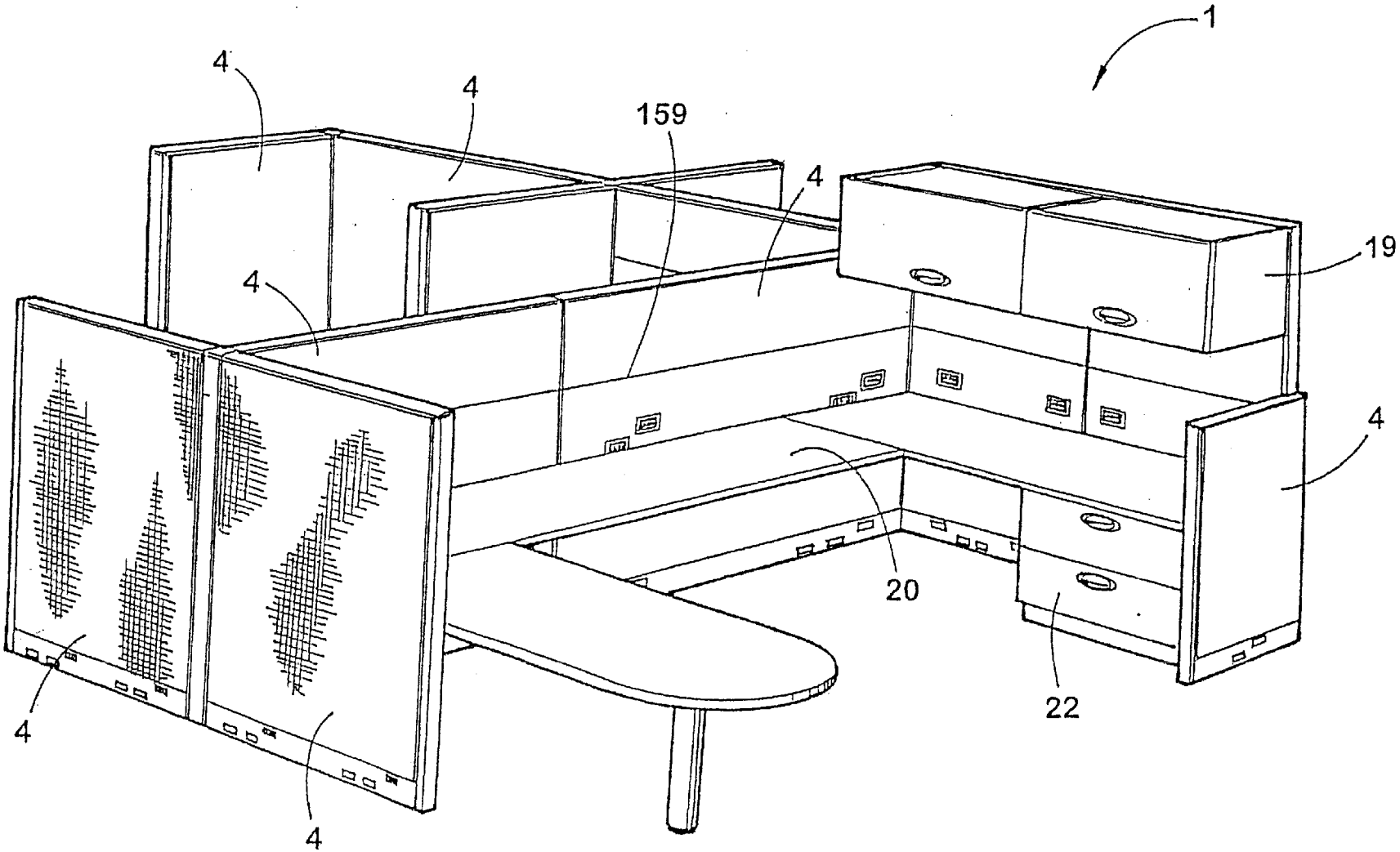
FIG. 1 is a perspective view of a knock-down partition system embodying the present invention comprising a post and beam construction which is covered by acoustic, decorative cover panels.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 4:
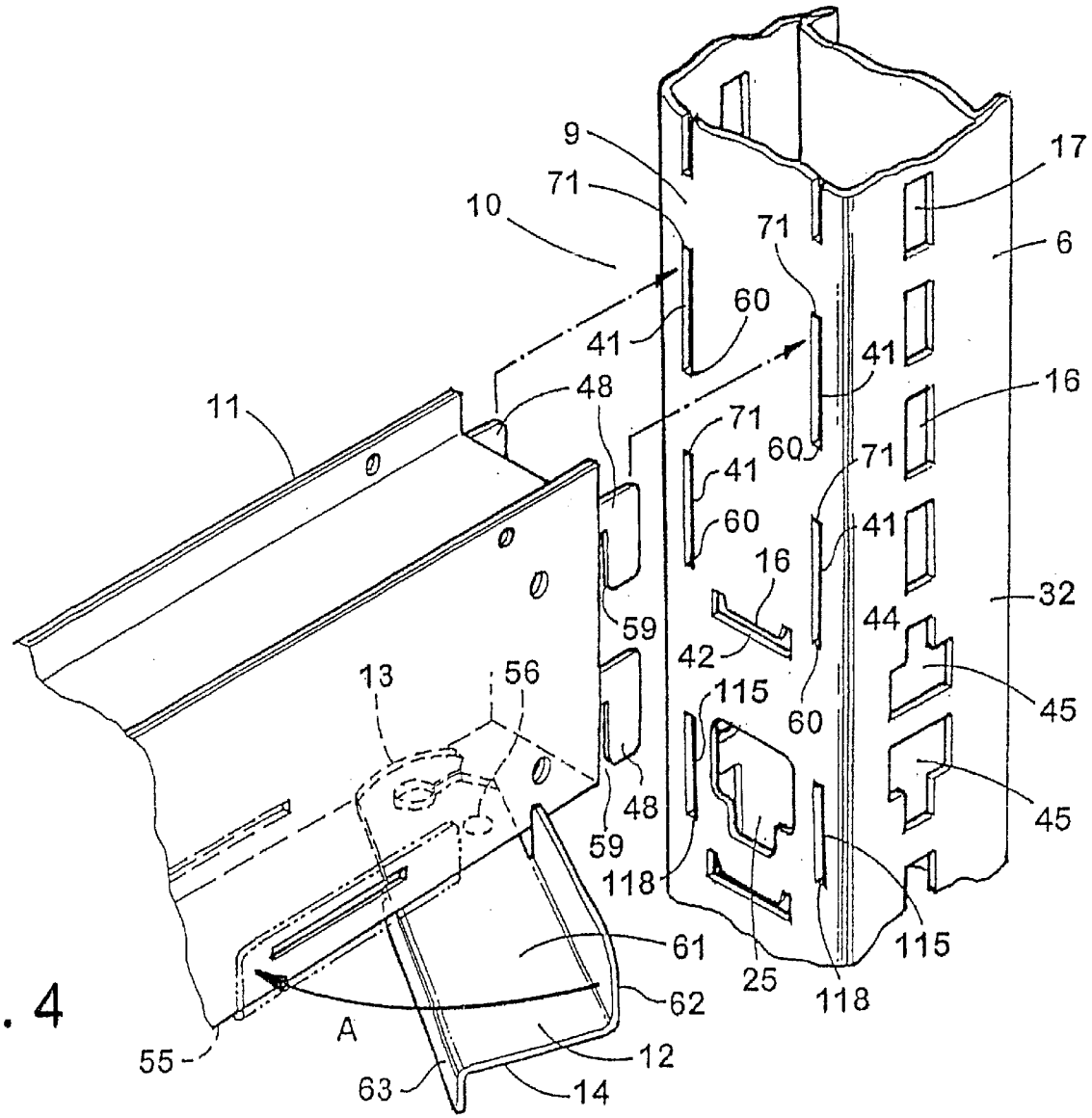
FIG. 4 is a fragmentary, perspective view of the lock member and beam connection port.
Figure 5:
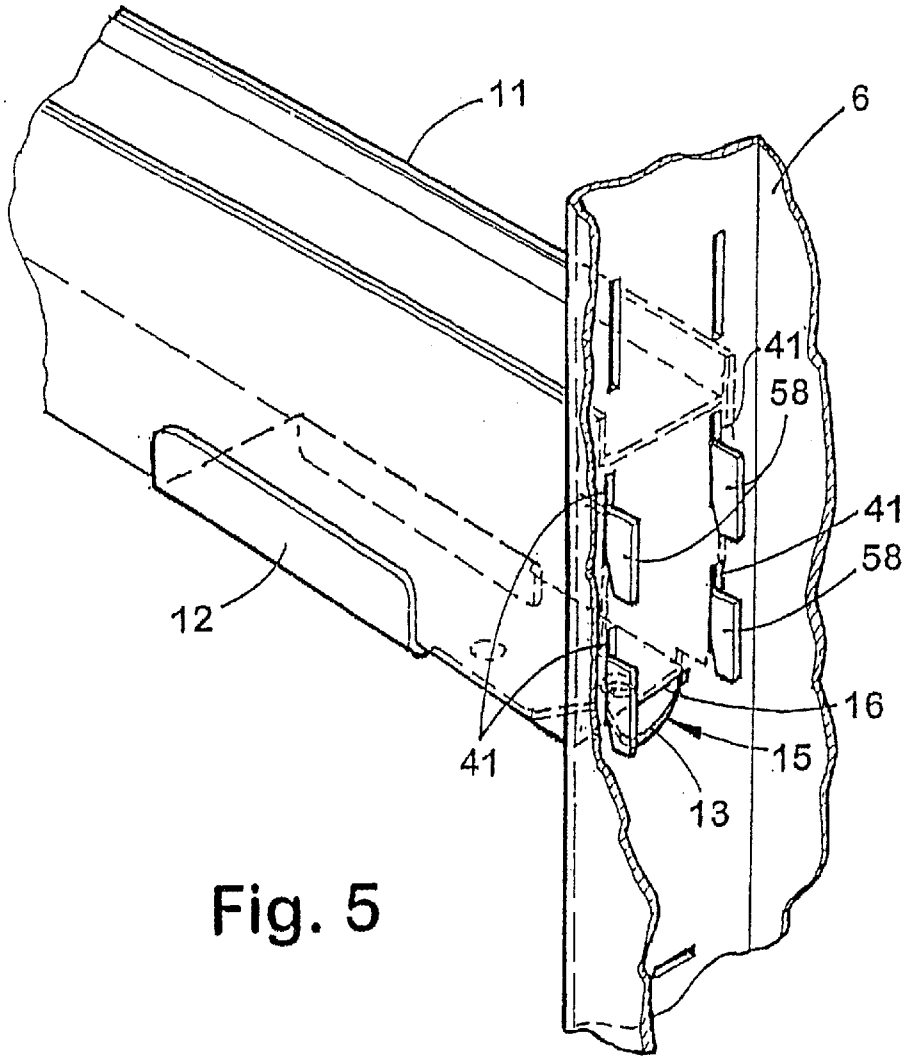
FIG. 5 is a fragmentary, perspective view of the lock member in the engaged position showing the elastic deformation of the flexible extension.

The reference numeral 1 (FIG. 1) generally designates a knock-down portable partition system embodying the present invention. The illustrated knock-down portable partition system 1 has a panel frame 2 (see also FIGS. 2, 3) with a central portion 3. At least one cover panel 4 covers at least a portion of the central portion 3 of the panel frame 2. Connectors 5 detachably mount the cover panel 4 on the panel frame 2 to facilitate assembly and removal of the cover panel 4 on the panel frame 2. The panel frame 2 includes at least two vertical posts 6 each having an upper end 7, a lower end 8, and opposite faces 9 with at least two beam connection ports 10 thereon positioned adjacent the upper and lower ends 7, 8 of the associated one of the posts 6. Upper and lower bars or beams 11 extend generally horizontally between the vertical posts 6 adjacent the upper and lower ends 7, 8 thereof, and interconnect the same adjacent the connection ports 10. Panel frame 2 includes movable lock members 12 having flexible extensions 13. Lock members 12 are positioned on one of the posts 6 and the beams 11 adjacent the connection ports 10, and are movably mounted thereon for shifting between an unlocked position 14 and a locked position 15. As best seen in FIGS. 4 and 5, lock-engaging surfaces 16 are positioned on the other of the posts 6 and the beams 11 adjacent the connection ports 10, and are located thereon to engage the flexible extensions 13 when the lock members 12 are shifted to the locked position to rigidly yet detachably interconnect the posts 6 and the beams 11 for quick and complete assembly and disassembly of the knock-down portable partition 1.

Figure 2:
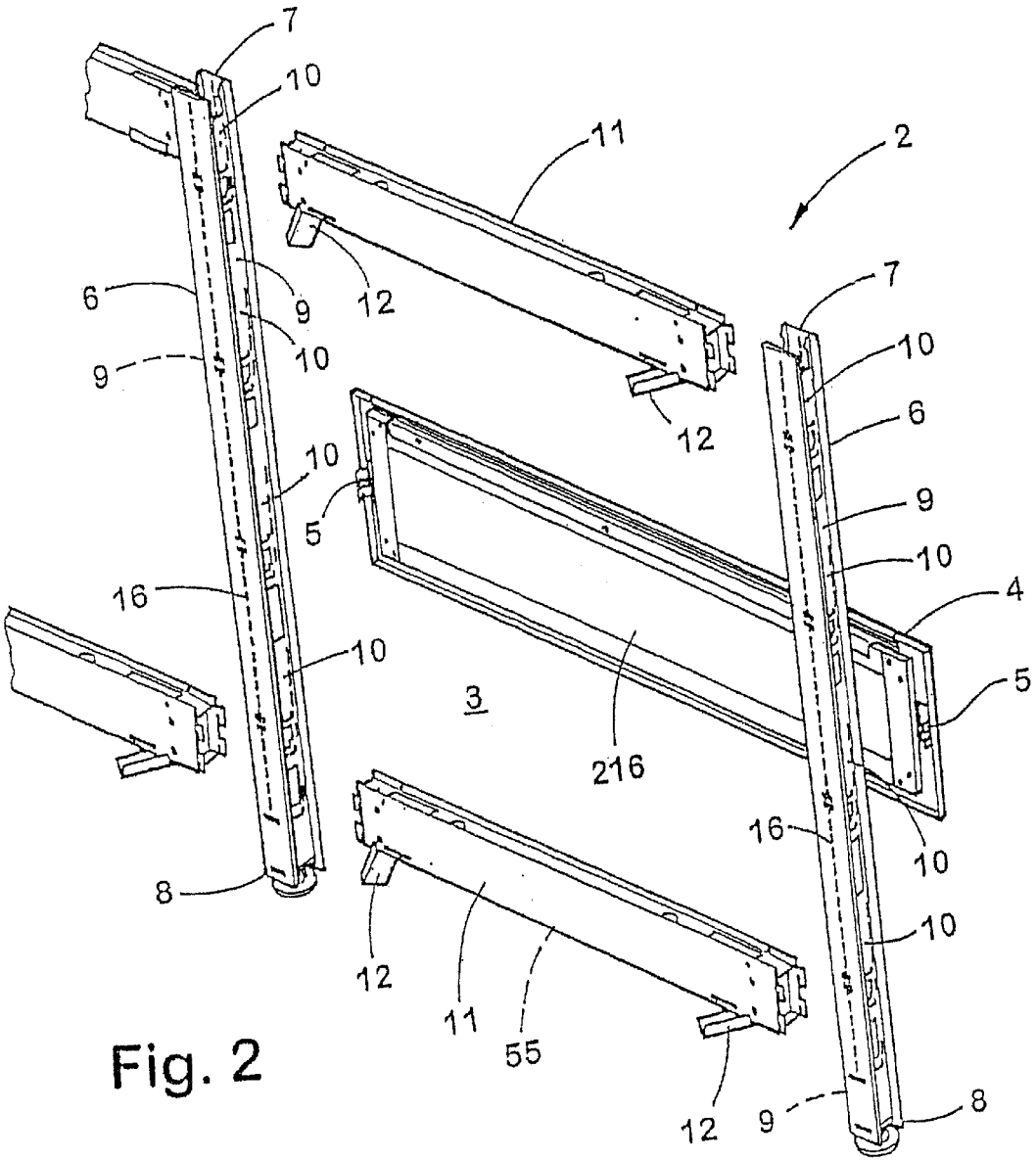
FIG. 2 is a fragmentary, exploded perspective view of the vertical posts, beams, and cover panel.
Figure 3:
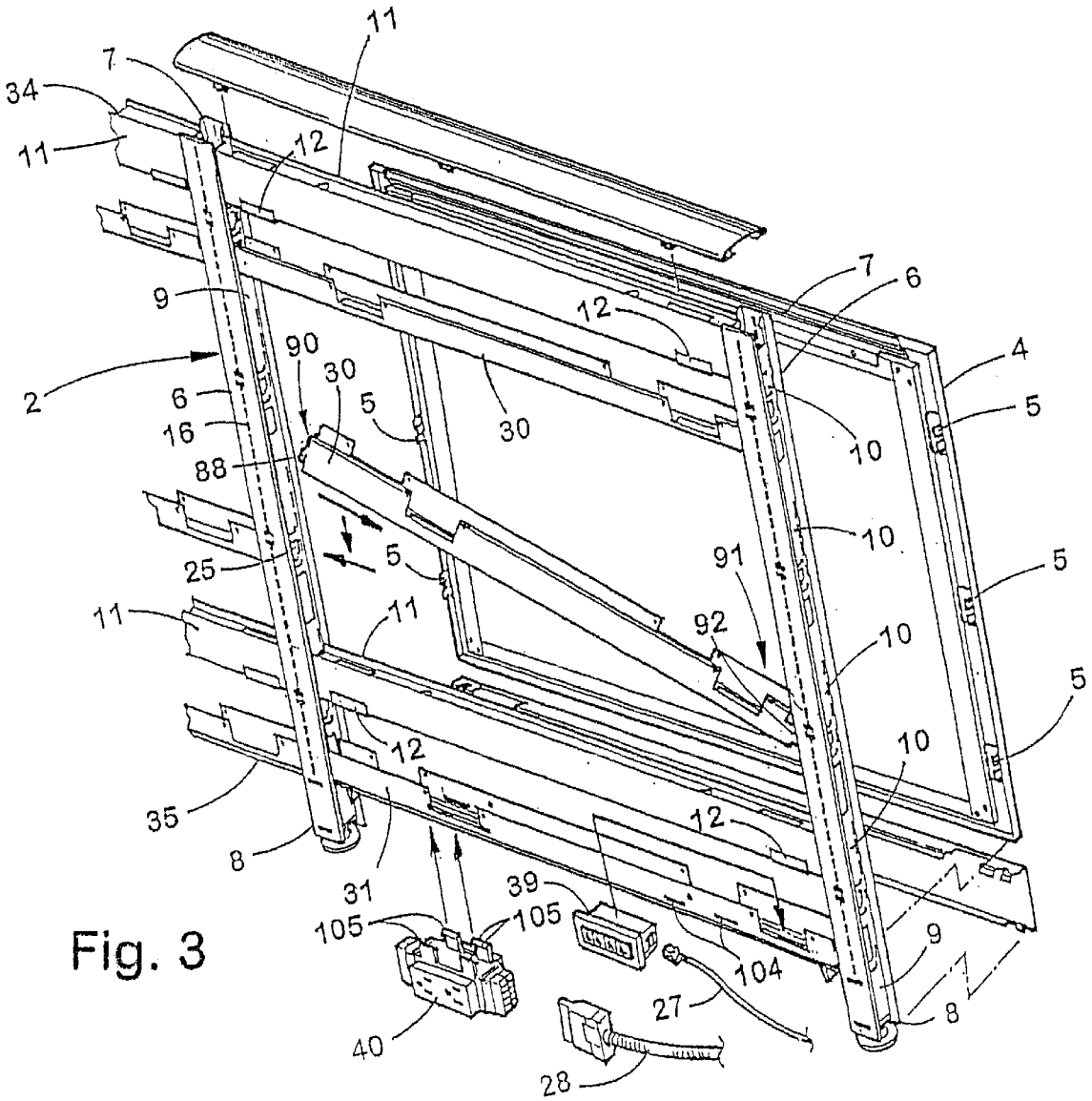
FIG. 3 is a fragmentary, exploded perspective view of the vertical posts, data and power troughs, beams and cover panel.

With reference to FIGS. 2 and 3, each vertical post 6 includes a plurality of utility trough ports 25 with associated windows 26 (See also FIG. 8) through the posts 6 for passing utility conduits such as data or communications lines 27 or power lines 28 therethrough. The partition 1 includes at least one utility trough such as data trough 30 or power trough 31 that is shaped to receive and retain utility conduits therein. The utility troughs have opposite ends thereof configured to be detachably connected with a horizontally aligned pair of utility trough ports 25 on the posts 6 when the panel frame 2 is in an assembled condition.

Figure 7:
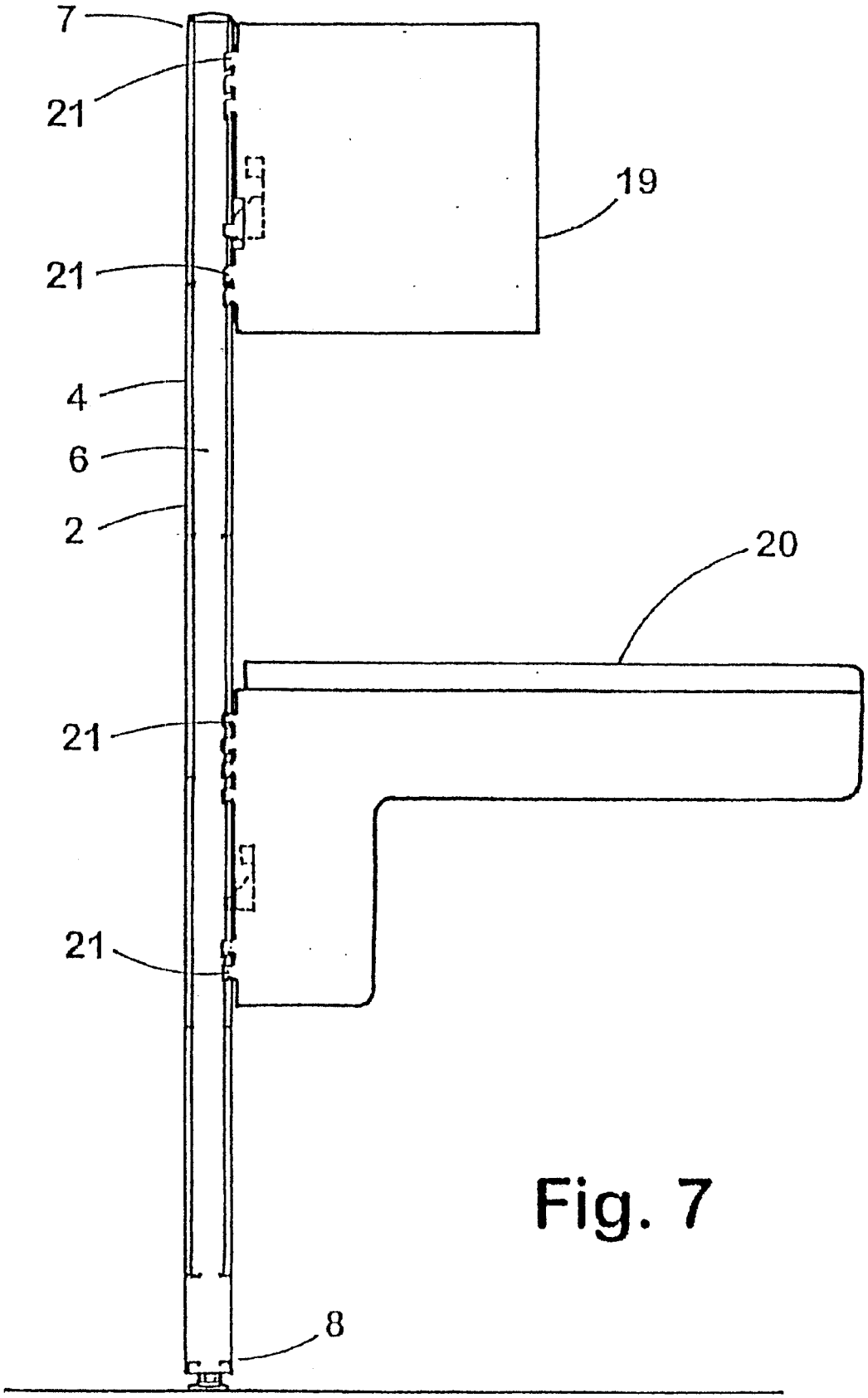
FIG. 7 is a partially schematic side elevational view of the partition system with hang-on bins and work surfaces installed.

Each post 6 includes a vertical row of slots 17 extending along a vertical face 18. The vertical row of slots 17 receive hooks 21 to removably attach hang-on accessory units such as a binder bin 19 or a work surface 20 (FIG. 7). A lower file storage unit 22 (FIG. 1) may also be removably supported by the vertical row of slots 17 in the posts 6. Posts 6 are each constructed to have sufficient structural strength to support the hang-on accessory units.

Figure 9:
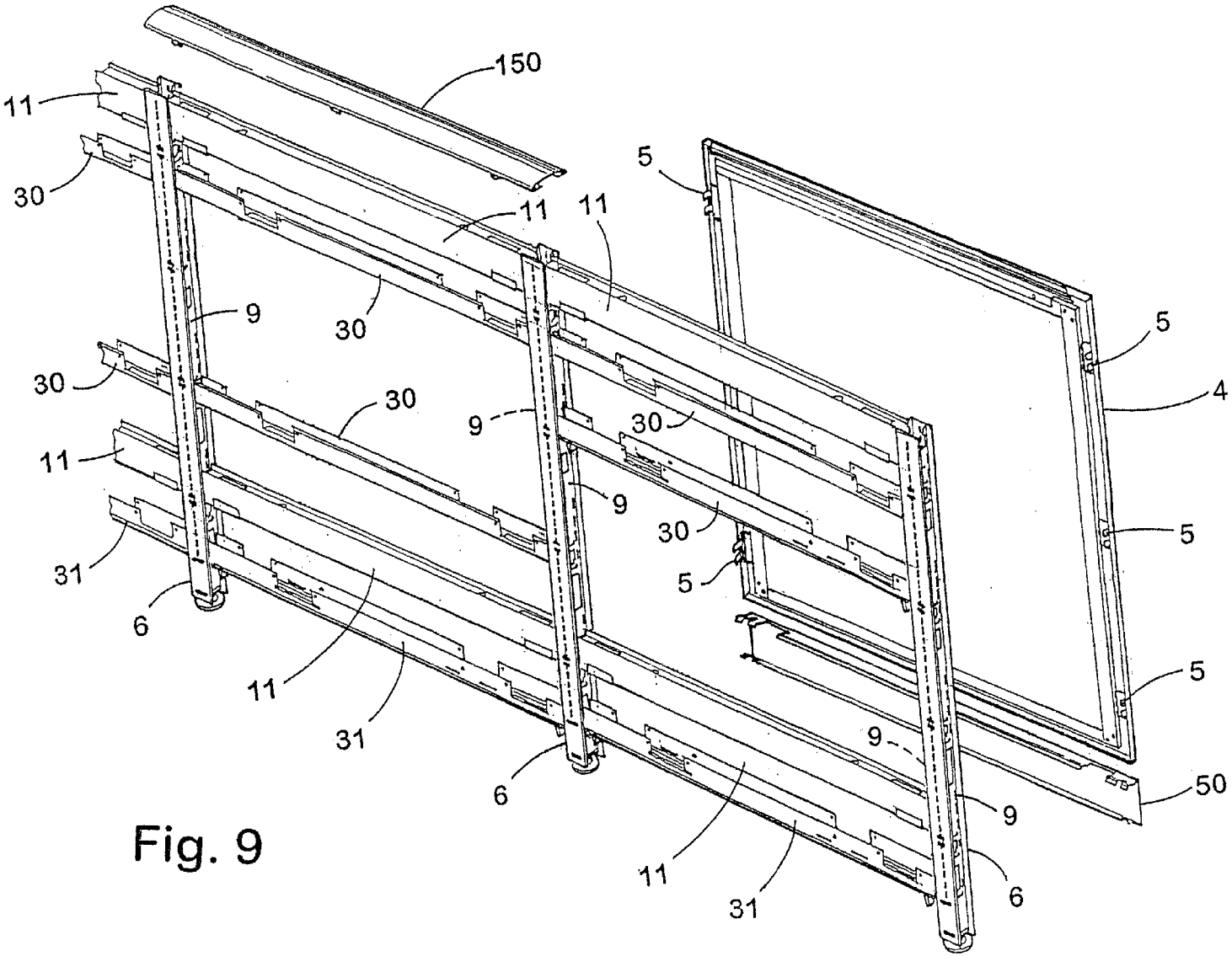
FIG. 9 is a fragmentary, perspective view of two adjacent panel frames showing an intermediate post with beams rigidly connected to both opposite side faces.

As best seen in FIG. 9, two adjacent rigid panel frames 2 are formed by three vertical posts 6 and at least four beams 11 extending generally horizontally between the posts 6 adjacent the upper and lower ends 7, 8 thereof. The beams 11 provide the primary structural interconnection between the posts 6, with the cover panels 4 providing acoustical and decorative functions.

As shown in FIGS. 10–13, each vertical post 6 has a pair of opposite faces 9 and front faces 32. Each post 6 includes an upper utility trough port 33 with a window that is open along the upper side for lay-in of utility conduits such as data lines 27 along the top edge 34 (FIG. 3) of the panel frame 2. In addition, each post 6 has a utility trough port 25 adjacent the lower end 8, with a lower window 36 (see also FIG. 25) having an open lower edge for lay-in of utility conduits such as power lines 28 along the lower edge 35 (FIG. 3) of the panel frame 2. Each of the utility trough ports 25 has an upper window 37 and a lower rectangular window 38. Data and power lines 27, 28 that are routed in the data or power troughs 30, 31 may be passed through the windows 37. If required, one or more power boxes 40 (FIG. 3) may be connected to the bottom of a power trough 31 with power lines 28 routed through the rectangular windows 38.

Figure 8:
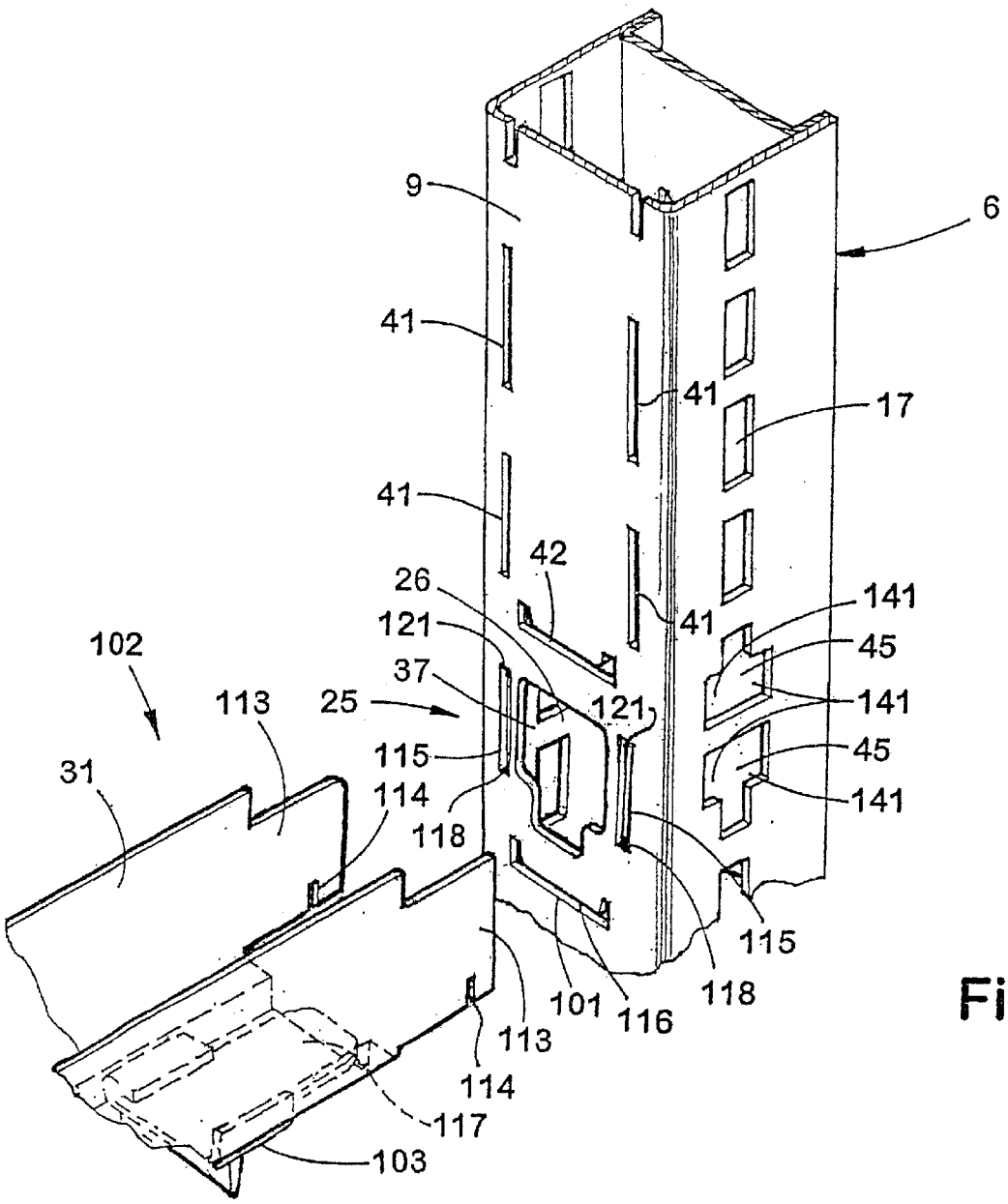
FIG. 8 is a fragmentary, perspective view of the utility trough port and a power trough with sliding wedge.
Figure 13:
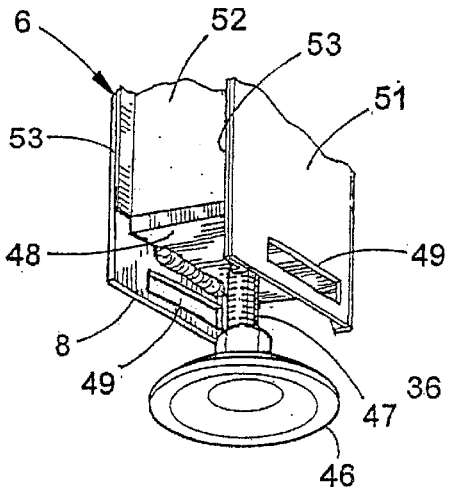
FIG. 13 is a fragmentary, perspective view of the bottom end of the vertical post showing the foot.
Figure 12:
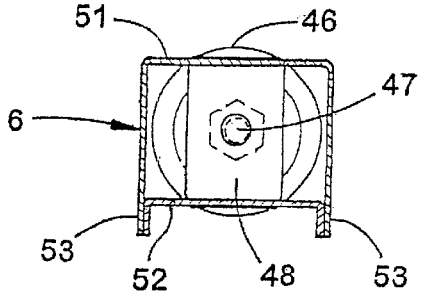
FIG. 12 is a cross-sectional view of the vertical post taken along the line XII—XII, FIG. 11.
Figure 10:
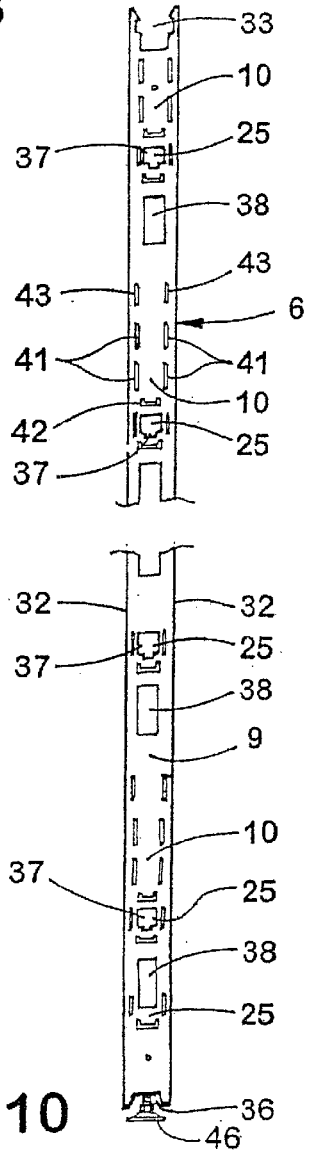
FIG. 10 is fragmentary, front elevational view of the vertical post.

As best seen in FIG. 8, each beam connection port 10 includes four vertical slots 41 and a horizontal slot 42. In addition, a pair of upper slots 43 (FIG. 10) are located directly above the beam connection ports 10 for connecting an upper utility trough 30 of a shorter panel frame 2 at a change of height location. Horizontal slot 42 of the beam connection port 10 has a downwardly extending tab 44 (FIG. 4) having a lock-engaging surface 16 along the lower edge thereof. As described in more detail below, front faces 32 of each post 6 include apertures 45 that receive connectors 5 for mounting cover panels 4. Each of the posts 6 have a single, vertically adjustable foot 46 with threaded portion 47 that is received in a threaded plate 48 welded to the lower end 8 of the post 6 (FIG. 13). As also described in more detail below, front face 32 of post 6 includes apertures 49 near the lower end 8 that removably mount a base cover 50. (See also FIG. 25). Posts 6 are made from a larger U-shaped piece 51 and a smaller U-shaped piece 52, each of which is roll-formed from sheet metal. The larger and smaller U-shaped pieces 51 and 55 are welded together along overlapping edge portions 45. Alternatively, posts 6 could have a one-piece, roll-formed tubular construction.

Figure 15:
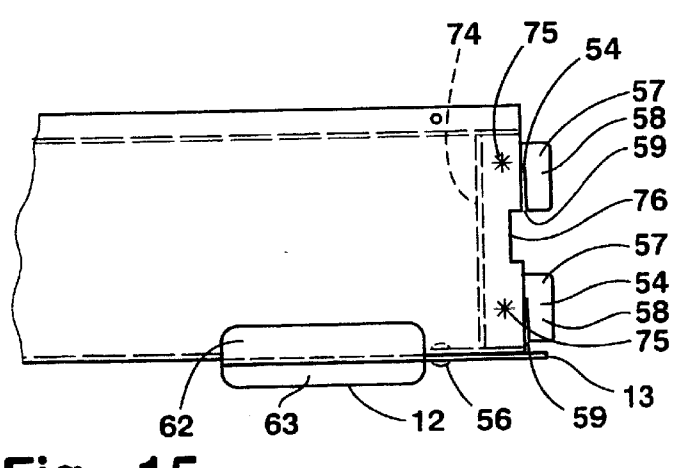
FIG. 15 is fragmentary, front elevational view of the beam.
Figure 16:
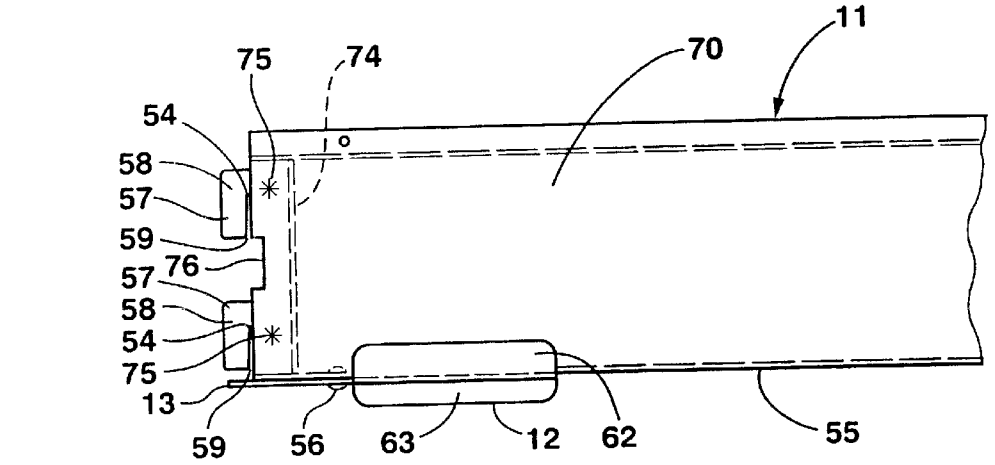
FIG. 16 is a side elevational view of the beam.
Figure 16:
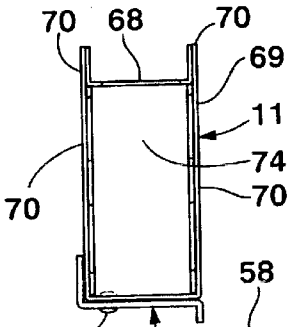
Figure 14:
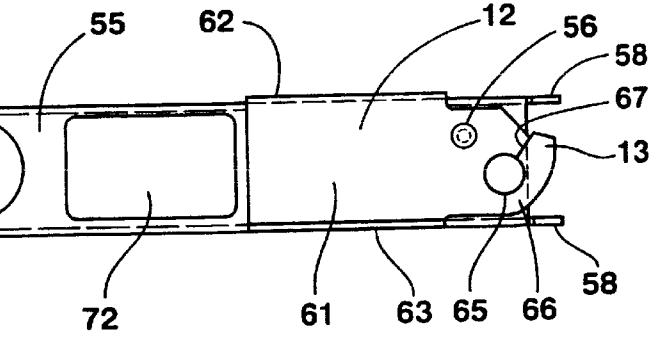
FIG. 14 is a fragmentary, bottom view of the beam.
Figure 14:
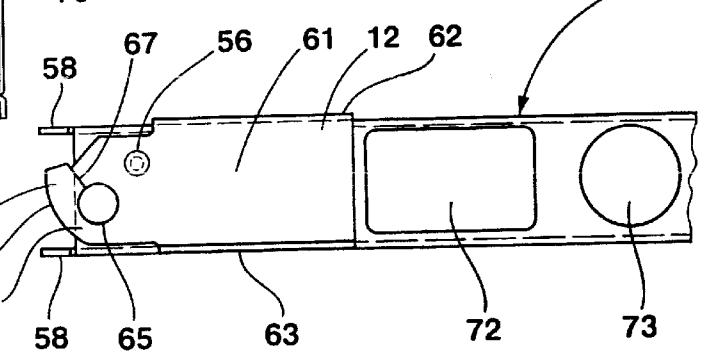
Figure 16A:
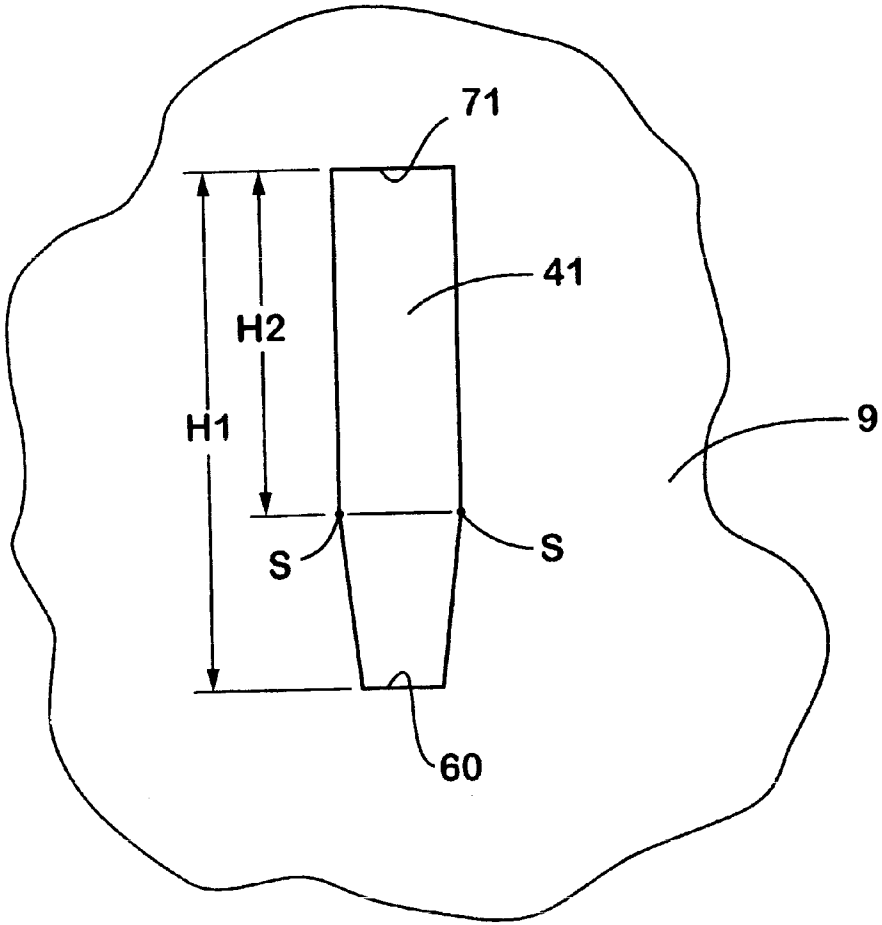
FIG. 16A is a fragmentary view illustrating the tapered slots in the side faces of the posts.

With reference to FIGS. 14–16, each beam 11 has a movable lock member 12 that is rotatably mounted to the lower side 55 of the beam 11 by a rivet 56. The beam 11 includes four tabs 57 and slots 54 that form downwardly extending hooks 58 at each end. Hooks 58 are formed on U-shaped end insert 74 that is spot welded to the sidewalls 70 of the beam 11 at 75. The insert 74 and hooks 58 are fabricated from a thicker sheet metal material than beam 11 to provide additional strength. Hooks 58 are received in vertical slots 41 of the beam connection port 10. Slots 59 of hooks 58 engage bottom edges 60 of vertical slots 40 (FIG. 4). Slots 59 have tapered, or angled side edges such that the width of the slot 59 is greater at the opening than at the base, or vertex 54. The taper of slot 59 ensures that beam 11 is securely and rigidly interconnected with post 6 when assembled. With further reference to FIG. 16A, vertical slots 41 in posts 6 have tapered, or angled side edges such that top edge 71 is wider than bottom edge 60. Top edge 71 has a width W1 of 0.165 inches, and bottom edge 60 has a width W2 of 0.115 inches. Slots 41 have a height H1 of 1.100 inches, and the side edges are parallel (i.e., 0.165 inches apart) along the upper 0.800 inch portion H2 of slot 41. The side edges taper inwardly to the 0.115 inch bottom edge 60 starting at a point S 0.300 inches from bottom edge 60. The taper of slots 59 further ensures that beam 11 is securely and rigidly interconnected with post 6 when assembled. Hooks 58 have a thickness that is approximately the same as the width of slot 41 at the bottom edge 60. Hooks 58 may also be slightly thicker or thinner than bottom edge 60 of slot 41. Base 54 of slot 59 is approximately the same width as the thickness of the sidewall of post 6. Base 54 can also be slightly wider or narrower than the thickness of the sidewall of post 6. The taper of slots 41 and 59 provide a snug wedging fit, ensuring that beam 11 rigidly and securely interconnects with posts 6. If hooks 58 are wider than lower edge 60 of slots 41, and/or base 54 of slot 59 is narrower than the thickness of the sidewall of posts 6, a downward force on beam 11 is required to seat hooks 58 in slots 41. A rubber mallet or other suitable tool can be used to quickly and easily seat hooks 58 in slots 41.

Lock member 12 is formed from sheet metal, and includes a flat body portion 61 that forms a lever arm for mechanical advantage such that the lock members 12 can be grasped and manually shifted from the unlocked position to the locked position by a person without the use of tools. An upwardly turned flange 62 provides a surface for a person to push against for manually rotating the locking member 12 in the direction of the arrow "A" (FIG. 4) to shift the lock member 12 to the locked position. Each locking member 12 also includes a downwardly-extending flange 63 that provides a flat surface to push against to rotate locking member 12 to the unlocked position.

Figure 6:
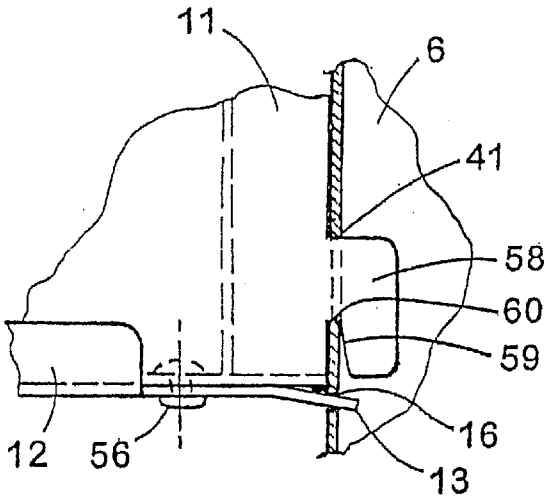
FIG. 6 is a fragmentary, front elevational view of the lock member in the engaged position showing the deformation of the flexible extension.

Each locking member 12 includes a flexible extension 13 (FIG. 14) having a curved outer edge 64. The flexible extension 13 is formed by cutting or separating the sheet metal along a line 67 to hole 65, thereby forming a base portion 66 of the flexible extension 13. Flexible extension 13 is thereby cantilevered to the body portion 61 of the locking member 12, such that flexible extension 13 is progressively flexed downwardly as extension 13 engages the lock-engaging surface 16 of post 6 during rotation of lock member 12 (see also FIG. 6). The elastic deformation of flexible extension 13 generates a force that pulls the hooks 58 downwardly into engagement with the slots 41, thereby securely locking each end of the beam 11 to the posts 6 and preventing upward movement and disengagement of hooks 58.

Each beam 11 may be made from an upper U-shaped piece 68 and a lower U-shaped piece 69 which are welded together along overlapping flange portion 30. Alternatively, beam 11 may have a one-piece tubular construction fabricated from sheet metal using a roll-forming process. Each beam 11 may include rectangular windows 62 and circular windows 122 through the beam 11 for vertical routing of data or power lines 23, 24 through the beams 11 within the panel frame 2. The area between hooks 58 is cut-out at 76. To remove a beam 11 from between a pair of posts 6, lock member 12 is shifted to the disengaged position, and beam 11 is shifted upwardly to disengage slots 59 from the bottom edge 60 of slots 41. A small pry bar or other suitable tool is then inserted into the opening between the posts 6 and the beam 11 created by the cut-out 76, and the posts 6 and beam 11 are pried apart, such that adjacent panel frames 2 are shifted slightly and hooks 58 disengage from the beam connection ports 10.

Beams 11 are installed by ensuring that locking members 12 are rotated to the disengaged, unlocked position. Hooks 58 at a first end of beam 11 are then inserted into slots 41 of a post 6 to position beam 11 at a desired vertical location. The first end of beam 11 is then shifted downwardly to engage slots 59 with bottom edges 60 of slots 41. Locking member 12 is then rotated to the locked position such that flexible extension 13 engages lock-engaging surface 16 to securely and rigidly interconnect beam 11 and post 6. A second end of beam 11 is then connected to another post 6 in the manner just described.

Beam 11 (as well as data and power troughs 30, 31) can be installed and removed from between a pair of posts 6 along a mid point of an assembled partition without disassembly of adjacent panel frames. To install a beam 11 between assembled panel frames, beam 11 is angled upwardly (or horizontally outwardly), and hooks 58 at a first end of beam 11 are inserted into slots 41 of a post 6. A second end of beam 11 is rotated downwardly (or horizontally inwardly), and hooks 58 at the second end of beam 11 are inserted into slots 41 of another post 6. If required, posts 6 are shifted apart slightly to provide clearance during installation of beam 11. Both ends of beam 11 are shifted downwardly to engage hooks 58 with slots 41, and lock members 12 are shifted to the locked position, as described above.

Figure 18:
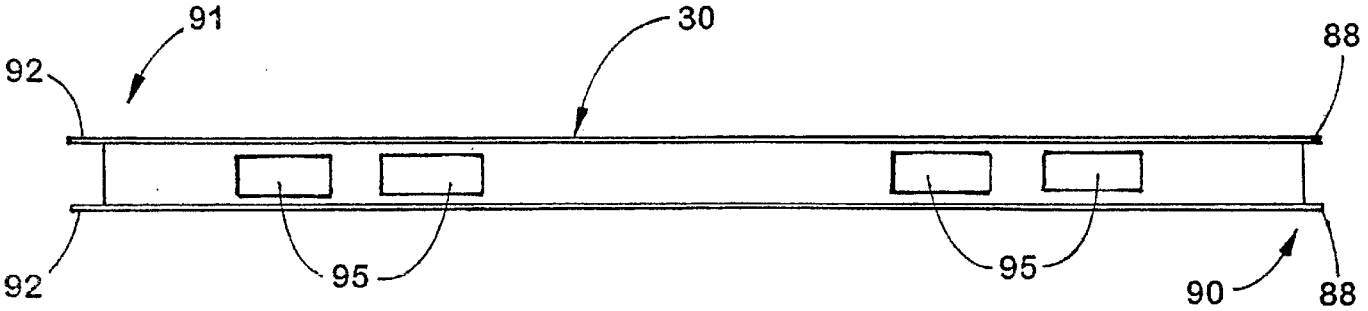
FIG. 18 is a top plan view of the data trough.
Figure 17:
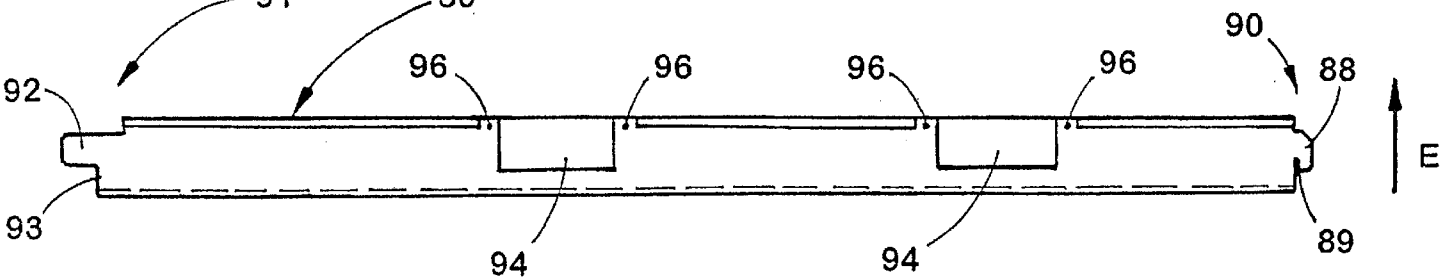
FIG. 17 is a front elevational view of the data trough.
Figure 19:
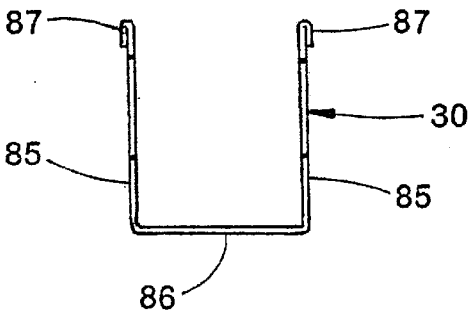
FIG. 19 is a side elevational view of the data trough.
Figure 21:
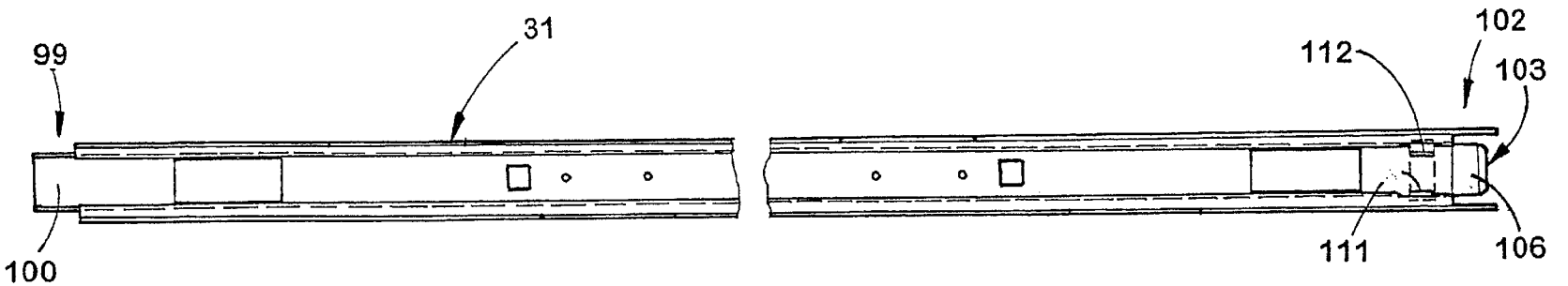
FIG. 21 is a fragmentary, top plan view of the power trough.
Figure 20:
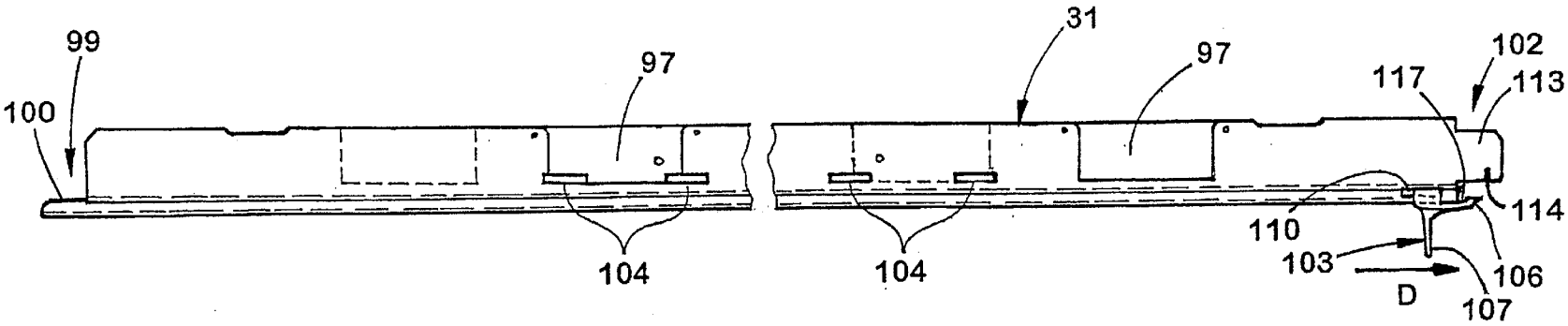
FIG. 20 is a fragmentary, front elevational view of the power trough.
Figure 22:
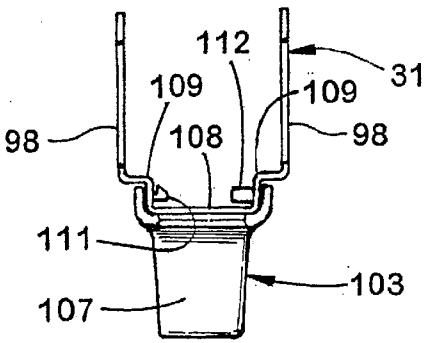
FIG. 22 is a side elevational view of the power trough.

Two types of utility troughs may be utilized for routing of data and power lines 27, 28. A data trough 30 is illustrated in FIGS. 17–19, and a power trough 31 is illustrated in FIGS. 20–22. Either trough may be used for routing of data or power lines 27, 28 within the trough. However, as discussed below, power trough 31 includes a lock such as sliding wedge 103 that rigidly connects the ends of the power trough 76 to the posts 6. Side forces are generated when a user plugs in or disconnects electrical lines from power boxes 40. The locking arrangement of power trough 76 permits mounting of power boxes 40 and power lines 28 below the power trough 31.

With reference to FIG. 19, each data trough 30 has a U-shaped cross-sectional shape with a bottom wall 86 and upwardly-extending side walls 85 that include a folded-over top edge 87 for strength. Each data trough 30 includes rectangular cut-out portions 94 and clearance holes 96 in side walls 85 for mounting data receptacles 39, and rectangular apertures 95 through bottom wall 86 for vertical routing of data and power lines 27, 28 within the panel frame 2. Each data trough 30 also includes a pair of tabs 88 (FIG. 17) and a slot 89 forming a downwardly extending hook at a first end 90. At a second end 91, the data trough 30 has a pair of tabs 92 with a cut-back portion 93. Cut-back portion 93 provides clearance when the first end 90 of the data trough is tipped upward in the direction of the arrow "E" (FIG. 17) during removal and installation of the data trough 30 between a pair of posts 6 when the panel frame 2 is assembled (FIG. 3).

With reference to FIGS. 20–22, each power trough 31 has a generally U-shaped cross-sectional shape, and includes cut-out portions 97 along the side walls 98 for mounting data receptacles 39 (FIG. 3). Each side wall 98 of the power trough 31 includes openings 104 that receive barbed extensions 105 of a power box 40 (FIG. 3), for removably mounting power box 40 below the power trough 31. A first end 99 of power trough 31 includes an upwardly opening U-shaped tab 100 which is received in a U-shaped slot 101 (FIG. 8) of a utility trough port 25. A second end 102 end of power trough 31 includes a movable lock member such as sliding wedge 103. Wedge 103 is moved in the direction of the arrow "D" of FIG. 20 after tabs 113 are positioned in slots 115 of utility trough port 25, thereby providing a secure connection that prevents movement of the power trough 31 when an electrical line is plugged into the power receptacle 40. Extension 106 of wedge 103 is closely received within the U-shaped slot 101, and a downwardly-extending grip or handle portion 107 that enables a user to slide the wedge 103 as required during installation or removal of the power trough 31. Power trough 31 includes a bottom wall 108 (FIG. 22), and a pair of smaller, offset lower side walls 109. Each lower side wall 109 includes a slot 110 adjacent the second end 102 of the power trough 31. Sliding wedge 103 includes support tabs 111 and 112 that are received within the slots 110 to slidably mount the wedge 103. When the sliding wedge 103 is inserted into the U-shaped slot 101, the upper surface 117 of the sliding wedge 103 contacts the upper edge 116 of the U-shaped slot 101, thereby generating a downward force on the second end 102 of the power trough 31. The downward force generated by the sliding wedge 103 insures that the slots 114 securely and rigidly engage the lower edge 118 of the tapered slots 115. Slots 114 of tabs 113 as well as slots 115 could be tapered to ensure that power trough 31 is rigidly interconnected with posts 6 when assembled. In this configuration, slots 114 have a wider opening than base portion, and slots 115 are wider at upper edge 121 than lower edge 118 (see also FIG. 8).

As best seen in FIG. 3, the data trough 30 may be installed by inserting tabs 92 at the second end 91 into the slots 115 of utility trough port 25 of a post 6. The first end 90 of the data trough 30 is then rotated downwardly until the tabs 88 are aligned with the slots 115 of a corresponding utility trough port 25 on the other post 6. The data trough 30 is then shifted in the direction of the first end 90 (up and left in FIG. 3) to insert the tabs 88 into the slots 115. First end 90 is then shifted downwardly to engage slots 89 onto lower edges 118 of slots 115. Slots 89 could also be tapered with a wider opening portion than base portion to ensure a secure, rigid interconnection between data trough 30 and post 6. Alternatively, data trough 30 may also be installed by inserting tabs 92 into slots 115 with the data trough angled outwardly. Data trough 30 is then rotated horizontally inward until tabs 88 are aligned with the slots 115 of a corresponding utility trough port 25 on the other post 6. Data trough 30 is then shifted in the direction of the first end 90 to insert tabs 88 into slots 115.

Figure 26:
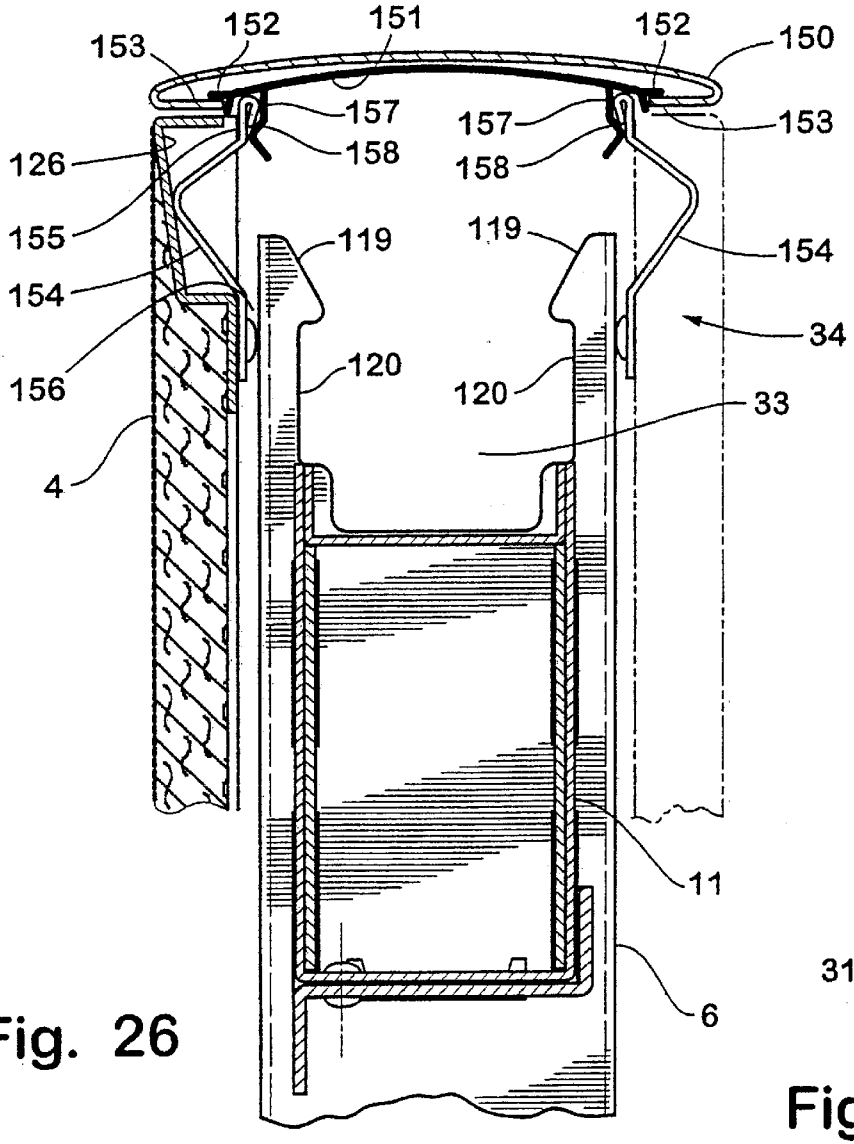
FIG. 26 is a fragmentary, side elevational view of the top portion of the assembled knock-down portable partition showing the top cap installed on the light seal of the cover panels.

With reference to FIG. 26, each of the upper utility ports 33 include tapered upper edges 119 and notched portions 120. During installation of the upper data troughs 30, the tabs 88 and 92 are pushed downward along the tapered edges 119 and snap into the notched portions 120.

Power troughs 31 are installed in a similar manner as a data trough 30. The tab 100 at the first end 99 of a power trough 31 is inserted into a U-shaped slot 101 of a utility trough port 25 (FIG. 8). The second end 102 of the power trough 31 is then rotated downwardly until the tabs 113 are aligned with the slots 115 of a utility trough port 25. The power trough 31 is then shifted in the direction of the second end 102 such that tabs 113 are received in slots 115. Power trough 31 is then shifted downwardly to engage slots 114 on the lower edge 118 of the slots 115. The sliding wedge 103 is then shifted in the direction of the arrow D (FIG. 20) until the extension 106 is received within the U-shaped slot 101 of the utility trough port 25. Power trough 31 may also be installed by inserting tab 100 and rotating second end 102 horizontally inwardly. Power trough 31 is then shifted in the direction of second end 102 to insert tabs 113 into slots 115. Second end 102 of power trough 31 is then shifted downwardly to engage slots 114 on lower edge 118 of slots 115.

Figure 11:
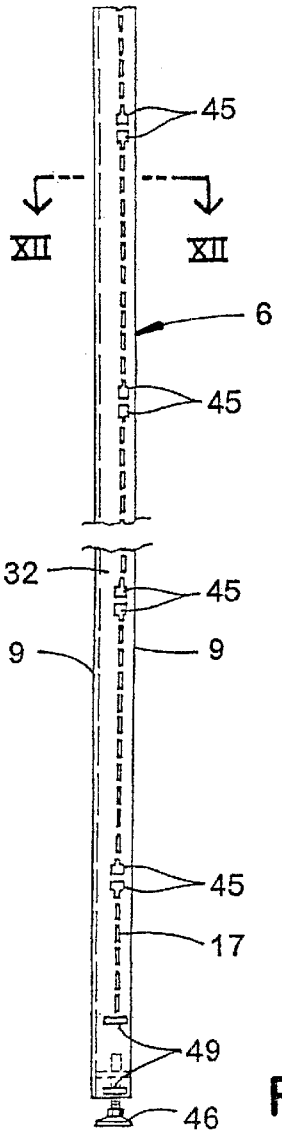
FIG. 11 is a fragmentary, side elevational view of the vertical post.
Figure 24:
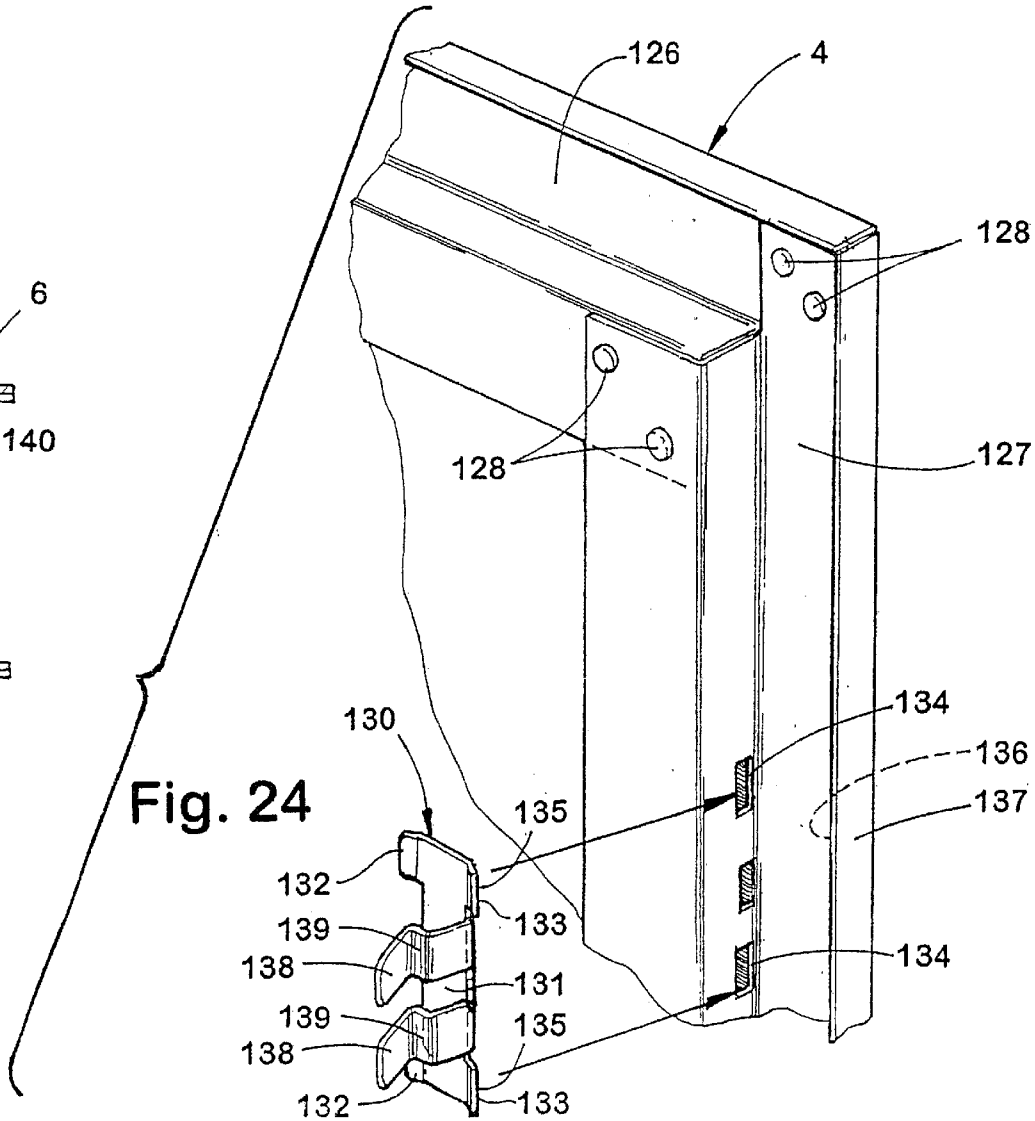
FIG. 24 is a fragmentary, perspective view of the cover panel showing the mounting of the cover retaining clips.
Figure 23:
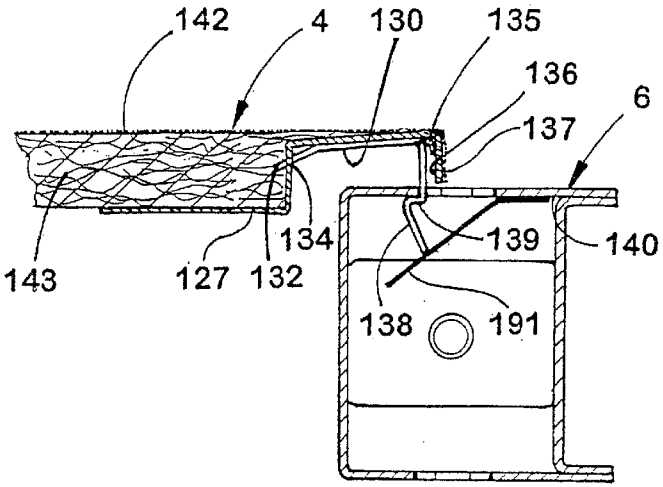
FIG. 23 is a fragmentary, top plan view of a vertical post showing the cover panel mounting clip engaging cover mounting apertures.

With reference to FIGS. 23 and 24, each cover panel 4 includes a perimeter frame 125 with horizontal numbers 126 and vertical numbers 127 that are "toggle locked" together at 128. Clips 130 are formed from spring steel, and have a generally flat body portion 131 with angled inner tabs 132 and outer tabs 133. Clips 130 are installed on cover panel 4 by inserting tabs 132 into openings 134 in the vertical member 127. The clip is then pushed inwardly such that outer edges 135 of outer tabs 133 abut the inner surface 136 of the outer flange 137 of the vertical member 127. During installation the cover panel 4, the flexible arms 138 are inserted into the openings 45 of posts 6 (see also FIG. 8), such that transverse portion 139 of each flexible arm 138 abuts an inner surface 140 (FIG. 23) of the post 6. Openings 45 include notched sides 141 (see also FIG. 8) that receive flexible arms 138 of clip 130, such that the center portion of the opening 45 provides a vertical slot 17 for mounting hang-on accessory units. As best seen in FIG. 11, openings 45 are located at evenly-spaced vertical increments, such that a plurality of segmented cover panels can be installed in a vertically juxtaposed relationship to one another (see FIG. 1). Each cover 4 includes an outer decorative fabric layer 142 (FIG. 23) and an acoustic layer 143 which may be made from a fiberglass mat or other suitable material.

Figure 25:
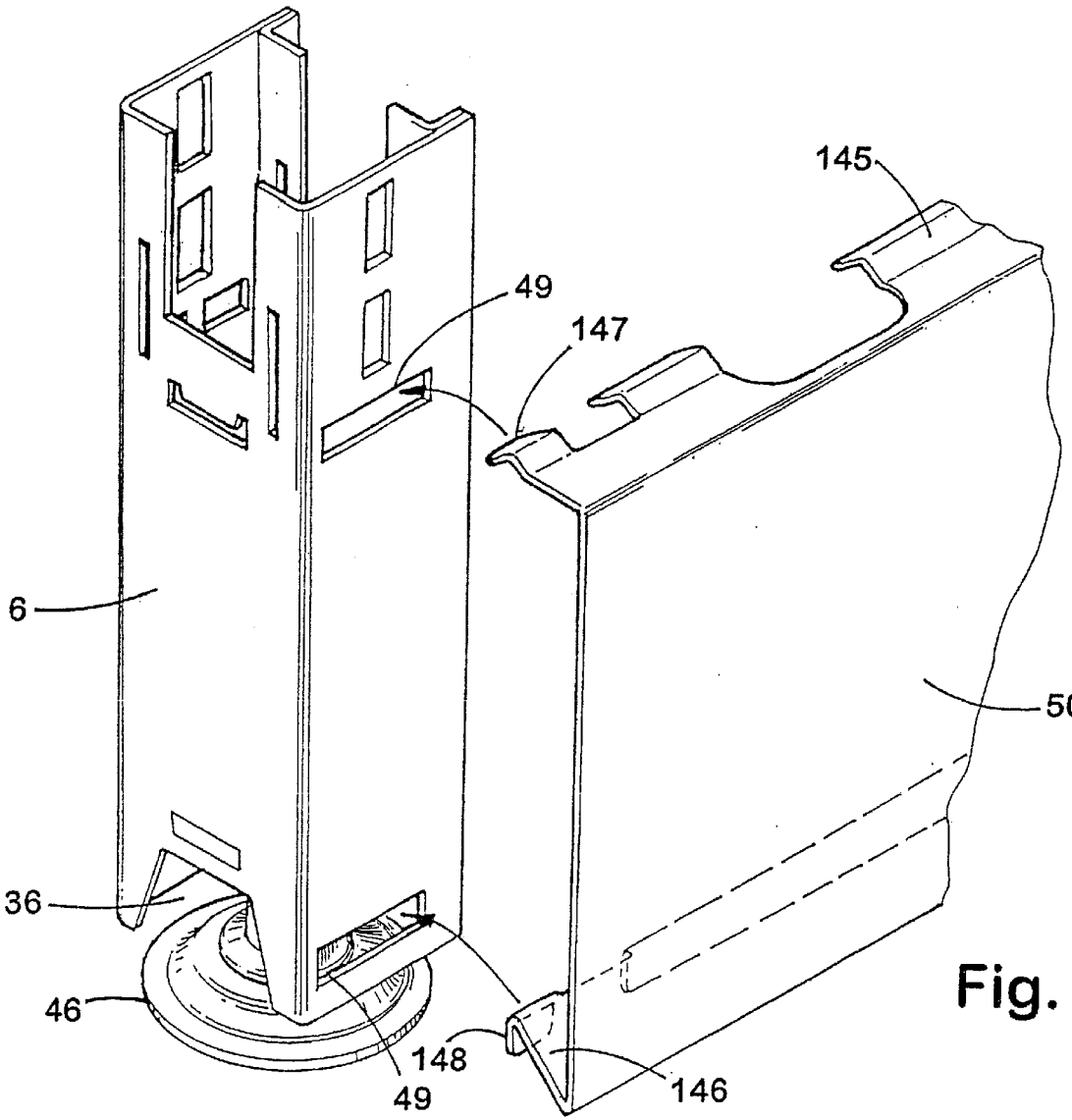
FIG. 25 is a fragmentary, perspective view showing the base cover and mounting tabs.

With reference to FIG. 25, base cover 50 is roll-formed from sheet metal and includes an upper flange 145 and a lower flange 146. An upper tab 147 at each end of the upper flange 145 engages an opening 49 in post 6, and a lower tab 148 engages an opening 49 to retain the base cover 50 to the post 6. A cut-out 149 in upper flange 145 provides clearance for vertical routing of data or power lines 27, 28.

With reference to FIG. 26, a light block 154 extends along the upper edge of each cover panel 4. The light block 154 is secured to the upper horizontal flange member 126 by fasteners 156, and includes an upwardly-extending upper flange portion 155 with a bent-back edge 157. Top cap retaining clip 151 includes outer arms 152 that engage inner edges 153 of top cap 150. Top cap 150 is retained to the light blocks 154 by a pair of flexible, downwardly-extending arms 158 of clip 151. During installation, the upwardly-extending flange 155 of light block 154 is inserted behind the lower edge of the cover panel directly above the cover panel being installed, thereby preventing light from passing through the horizontal joint 159 (FIG. 1) between the cover panels 4.

Figure 29:
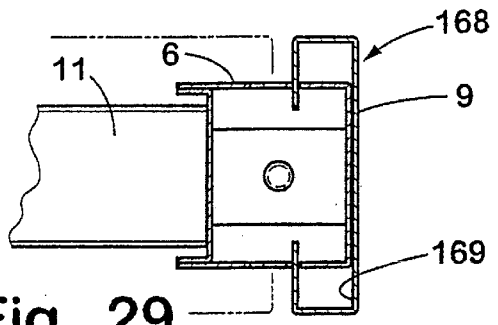
FIG. 29 is a fragmentary, top plan view of an end-of-run post with an end cover installed.
Figure 27:
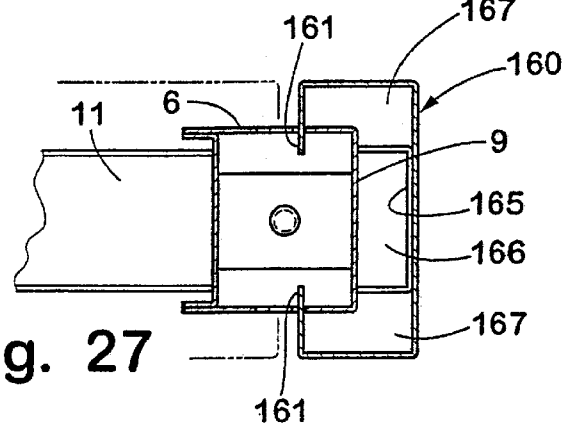
FIG. 27 is a fragmentary, top plan view of an end-of-run post with a change-of-height end cover installed.

With reference to FIG. 27, a change-of-height end cover 160 includes slotted tabs 161 which engage the cut-outs 162 at the top of a vertical row of slots 17 to cover the post 6. After the slotted tabs 161 are engaged, the lower end 163 of the end cover 160 is pushed over the lower end 8 of the post 6 to frictionally engage tab portions 125 against the front face 32 of post 6. The end cover 160 includes at least one U-shaped brace 165 that offsets the end cover 160 to provide a vertical passages 166, 167 (FIG. 27) for data and power lines 27 and 28. An end-of-run cover 168 (FIG. 29) is similar to the change-of-height end cover 160, except that inner surface 169 of end-of-run cover 168 abuts the side face 9 of post 6.

Figure 30:
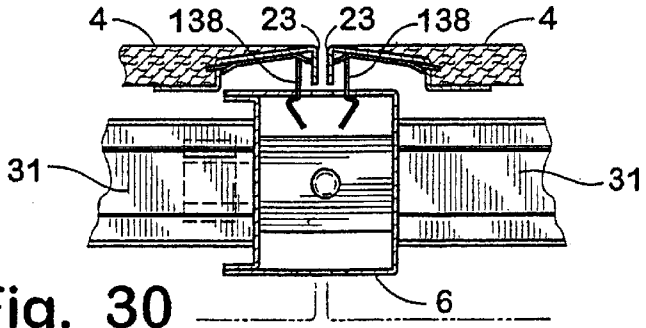
FIG. 30 is an intermediate post with cover panels installed on a front face, and power troughs installed on the opposite side faces.
Figure 32:
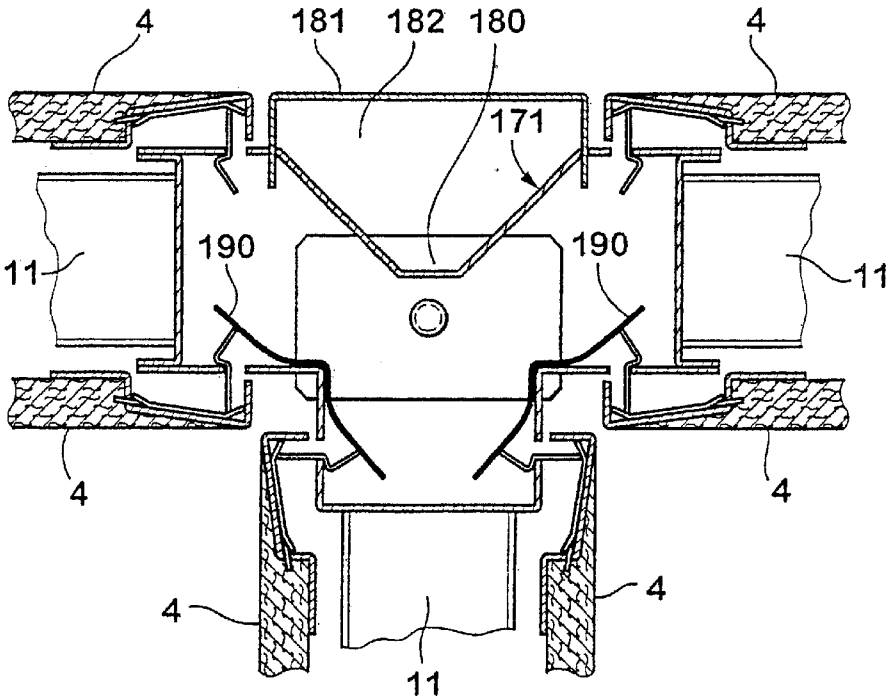
FIG. 32 is a fragmentary, top plan view of a T-post and cover.
Figure 31:
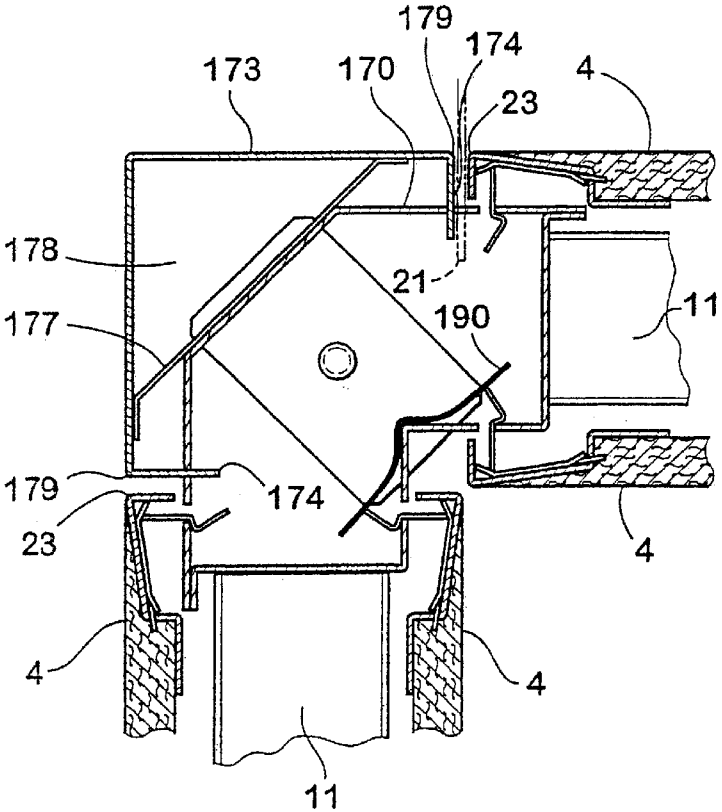
FIG. 31 is a fragmentary, top plan view of an L-post and cover.
Figure 33:
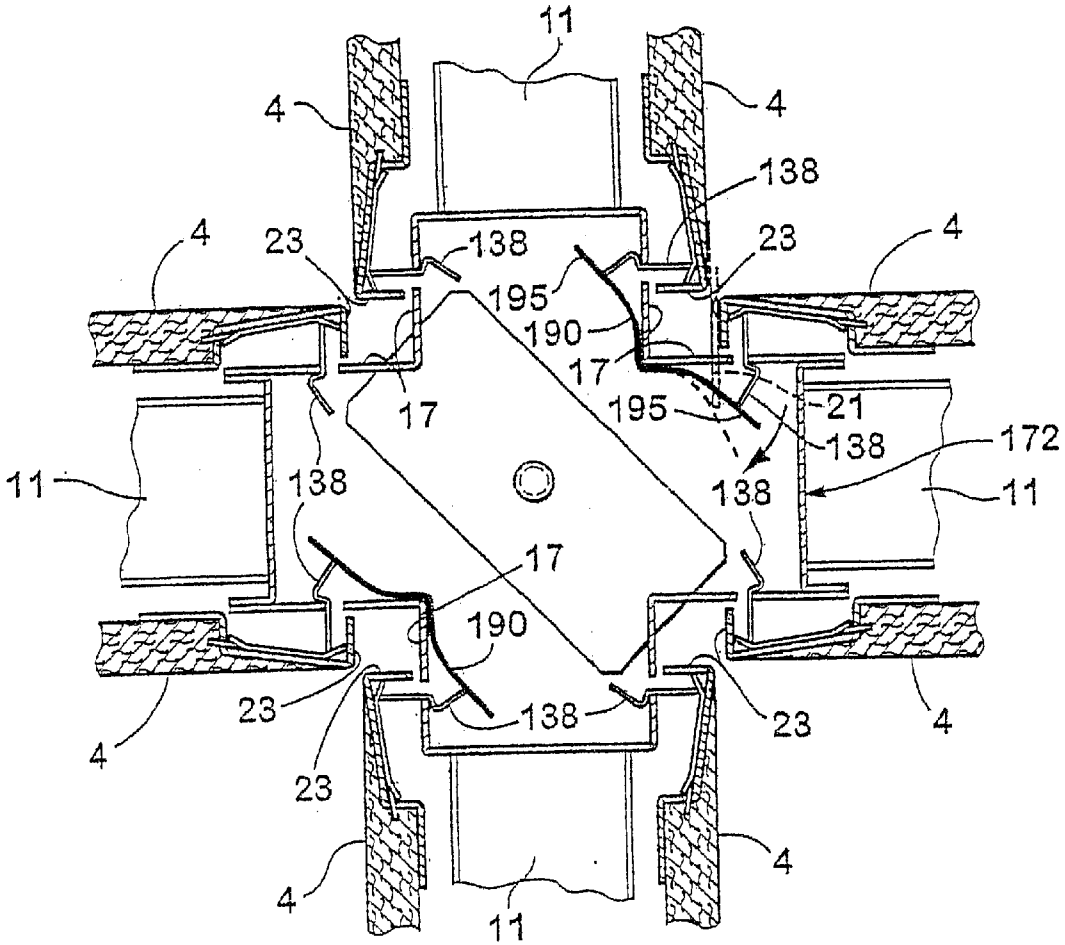
FIG. 33 is a fragmentary, top plan view of a X-post.
Figure 36:
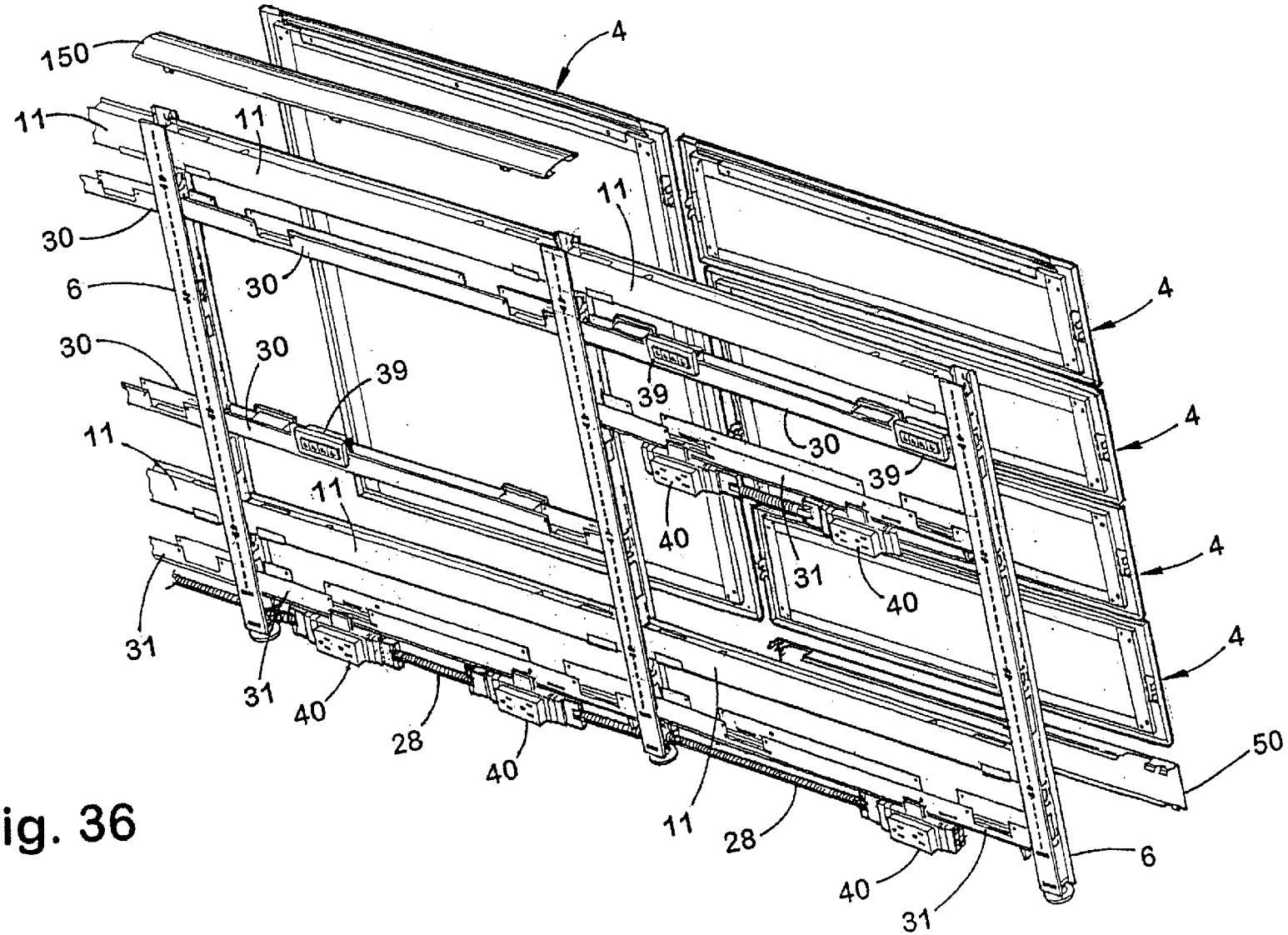
FIG. 36 is a fragmentary, exploded perspective view of the partition system showing the data and power lines and receptacles.

Partition system 1 may include an in-line/end-of-run post 6 (FIG. 30), an L-post 170 (FIG. 31), a T-post 171 (FIG. 32), and an X-post 172 (FIG. 33). The in-line/end-of-run post 6 may be used at either an end-of-run location with an end cover 160, or at an intermediate, in-line location as illustrated in FIG. 30. All of the post configurations have a single foot 46, and also have side faces with a plurality of beam connection ports 10 and utility trough ports 25 with substantially the same configuration as the in-line post 6. In addition, each of the posts include vertical rows of slots 17 for supporting hang-on accessory units. As described in more detail below, a flexible light seal 190 or 191 is adhesively secured inside each post to cover slots 17.

Figure 34:
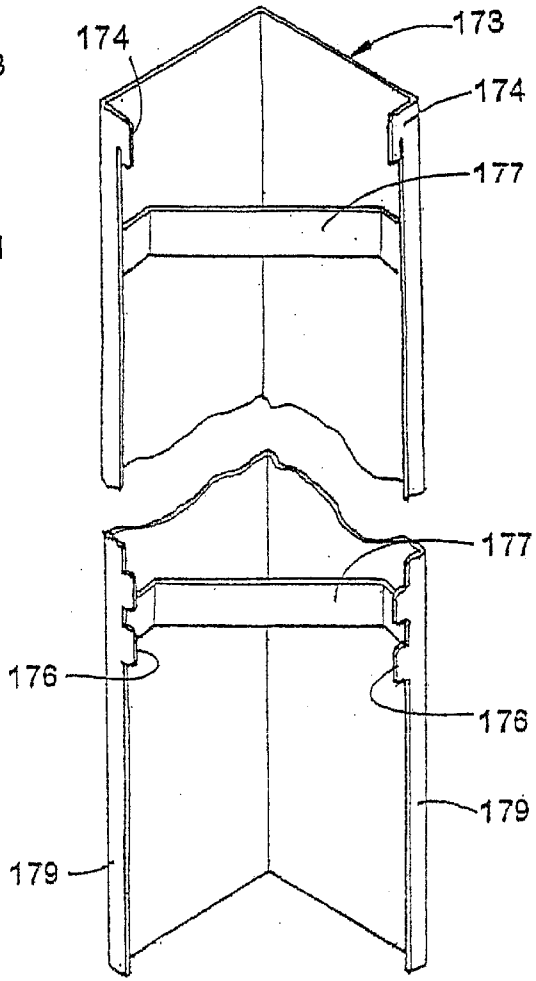
FIG. 34 is a fragmentary, perspective view of an L-cover.

Each L-post 170 (FIG. 31) may be covered by an L-cover 173 (FIG. 34). L-cover 173 includes hooks 174 for engaging slots 175 at the upper end of L-post 170. Each L-cover 134 also includes tabs 176 that engage the vertical row of slots 17 to retain the lower end of L-cover 173. Braces 177 provide rigidity at the upper and lower ends of the L-cover 173. The L-cover 173 provides a vertical passage 178 that may be utilized for vertical routing of data and power lines 27, 28. Side edges 23 of covers 4 are spaced-apart from side edges 179 such that hang-on binder bins or other accessories may be hung from the vertical row of slots 17.

Figure 35:
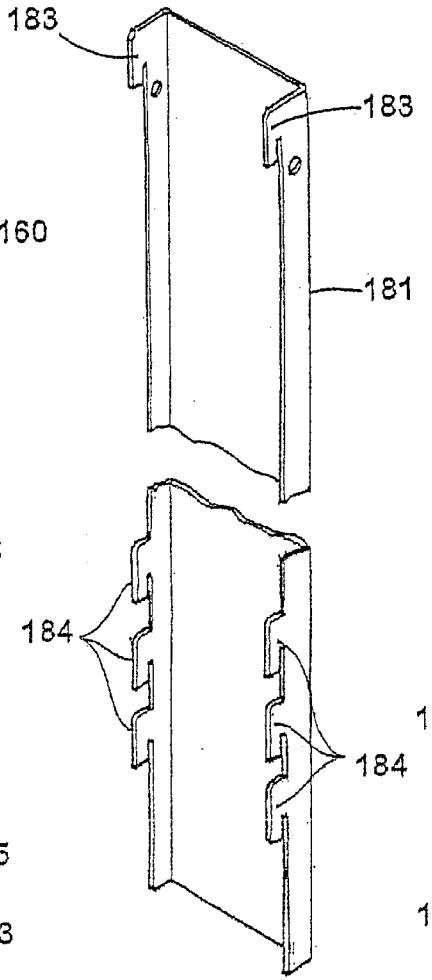
FIG. 35 is a fragmentary, perspective view of a T-cover.
Figure 28:
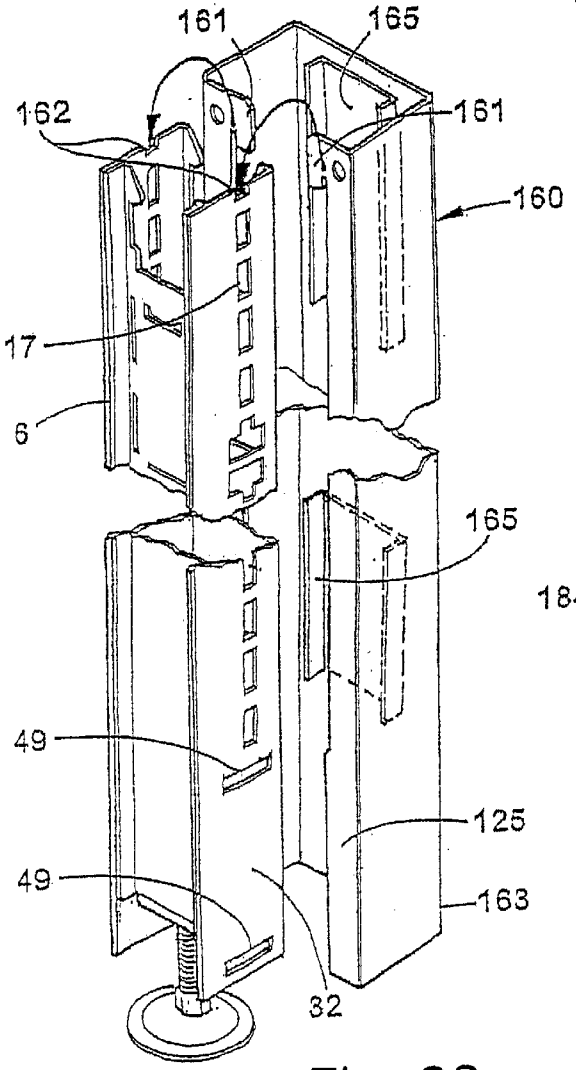
FIG. 28 is a fragmentary, perspective view showing an end cover and vertical, end-of-run post.

T-post 171 (FIG. 32) includes a recessed portion 180, which, in combination with the T-cover 181 (FIG. 35), provides a vertical passage 182 for vertical wiring of power or communications cabling. T-cover 181 includes upper and lower hooks 183, 184 that engage slots 17.

With reference to FIG. 33, an X-post 172 has a generally X-shaped plan configuration for joining four panel frames 2 in an X formation. Side edges 23 of cover panels 4 are spaced-apart to provide clearance to mount hang-on accessory units from slots 17.

Figure 37:
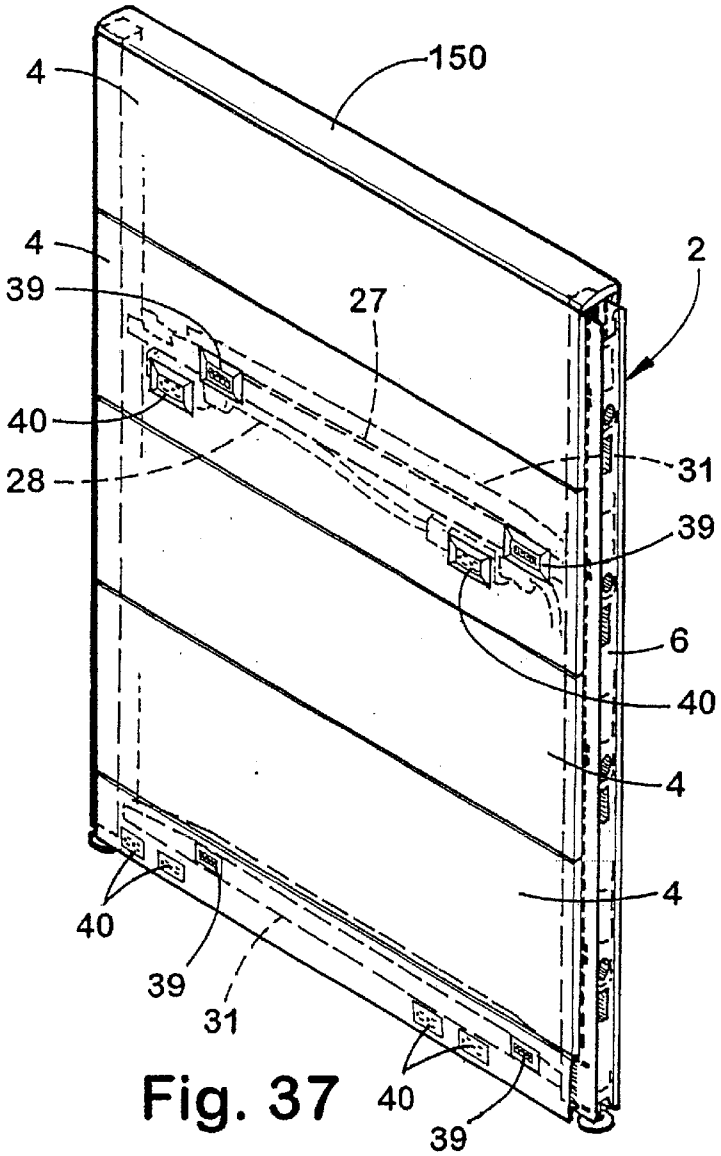
FIG. 37 is a perspective view of an individual panel section showing the data and power receptacles at the base and beltway heights.

With reference to FIG. 34, the data and power troughs 30 and 31 provide a flexible, easily installed system for support of data and power lines 27 and 28, and data and power receptacles 39, 40. Data and power lines 27, 28 may be routed vertically through the apertures in the utility troughs and beams. As illustrated in FIG. 37, a single power trough 31 mounted at a beltway level may provide for both data receptacles 39 and power receptacles 40. Data lines 27 are routed within power trough 31, and power conduits 28 are routed below power trough 31. The base covers 50 are also cut-out for mounting data and power receptacles 39 and 40 at the base of the panel.

Figure 38:
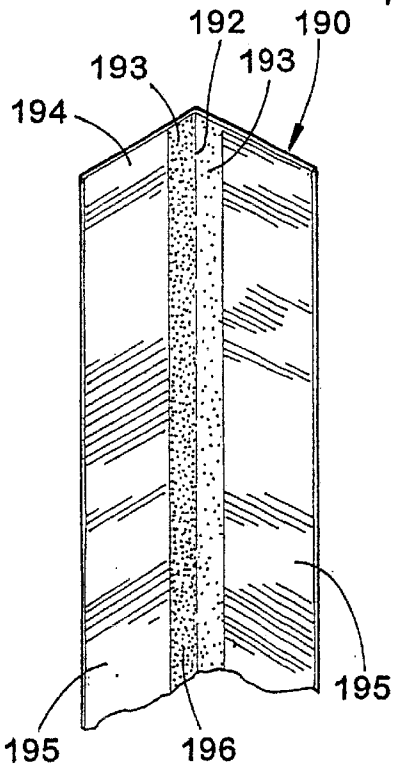
FIG. 38 is a fragmentary, perspective view of a light seal for X, L, and T-posts.

Flexible light seal 190 (FIG. 38) is made from a non-translucent thin polymer sheet such as LEXAN polycarbonate, available from General Electric Co., Schenectady, MA. The polycarbonate sheet is scored on a line 192. Adhesive 193 is disposed on inner surface 195 of base portion 196 on each side of the scored line 192. Adhesive 193 secures the light seal 190 to an inner corner of a L post 170, T post 171 or X post 172. Light seal 190 flexes along score line 192 to conform to the inner surface of the post. Base portion 196 of the light seal 190 is secured to the inner surface of the post, and flaps 195 extend over the adjacent vertical row of slots 17, such that upon insertion of the hooks 21 of a hang-on accessory unit, or flexible arm 138 of cover panel clips 130, the flap 195 deflects inwardly (FIG. 33). Light seal 190 prevents passage of light between adjacent work areas through the partition system 1.

Figure 39:
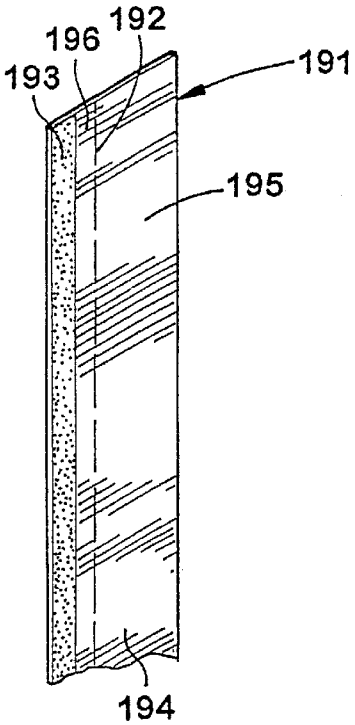
FIG. 39 is a fragmentary, perspective view of a light seal used with end-of-run posts.

Another type of flexible light seal 191 (FIG. 39) is used to cover vertical rows of slots 17 of an end-of-run post 6. Adhesive 193 is applied to the base portion 196, and flap 195 extends over the adjacent rows of slots 17. Light seal 191 may be scored at 192 such that flap 195 flexes along score line 192 upon insertion of hooks 21 or arm 138 of clips 130. After the adhesive 193 is applied to the inner surface 194 of a light seal 190 or 191, the light seal is inserted into the post with the adhesive facing upwardly. The light seal 190 or 191 is then turned over, and positioned with the flap or flaps 195 over the vertical rows of slots 17. Force is then applied to the light seal 190 or 191 to securely bond the light seal to the inner surface of the post.

Figure 40:
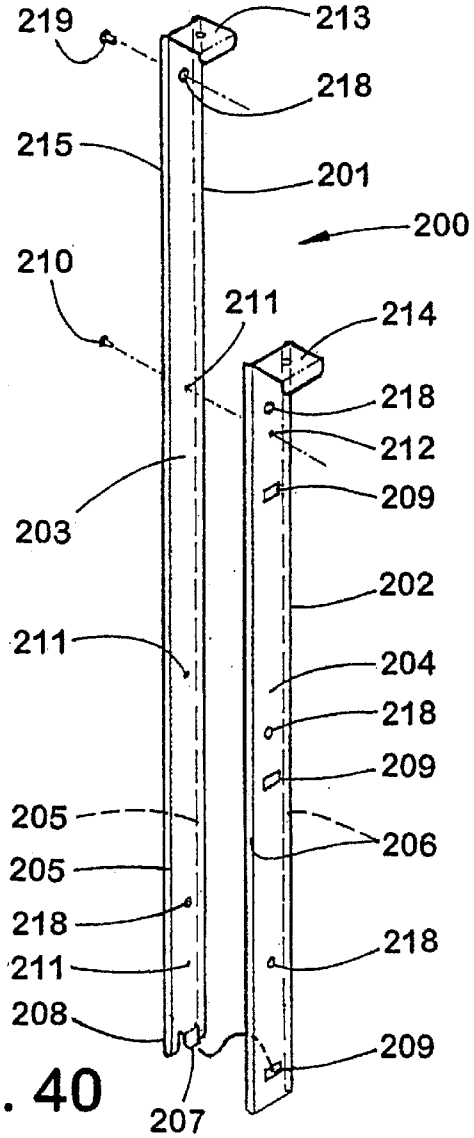
FIG. 40 is an exploded perspective view of an longitudinally extensible cover panel brace.
Figure 41:
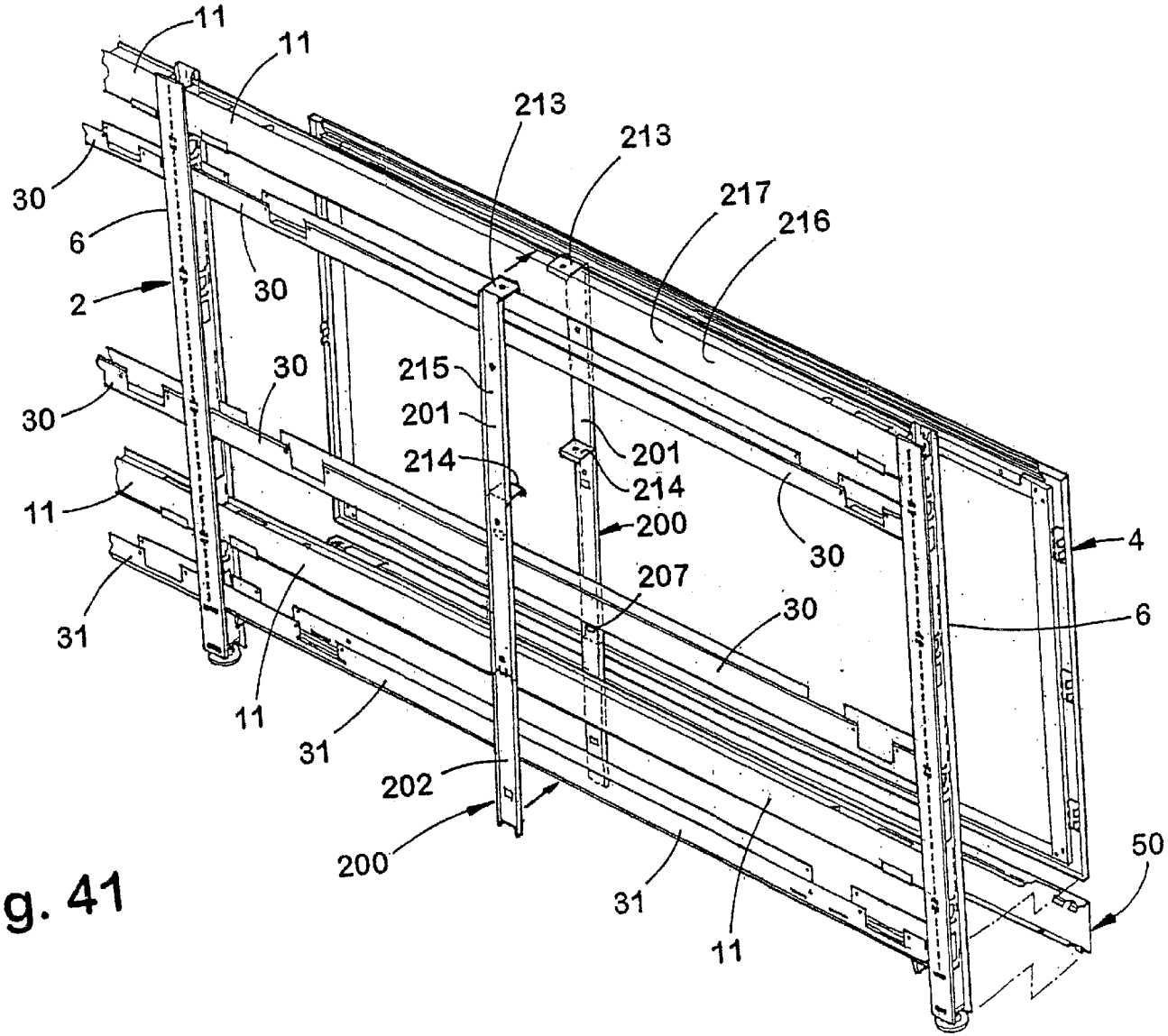
FIG. 41 is a fragmentary, exploded perspective view of the partition system showing the installation of the cover panel brace.

With reference to FIGS. 40 and 41, a longitudinally extensible cover panel brace 200 includes an upper member 201 and a lower member 202. Upper and lower members 201, 202 include vertically elongated main sections 203 and 204 having a U-shaped cross section with side flanges 205 and 206. Elongated section 203 of upper member 201 fits within the elongated section 204 of the lower member 202, and a tab 207 adjacent the lower end 208 of upper member 201 is received within a selected opening 209 in lower member 202. A screw or other fastener 210 fits through a selected clearance hole 211 in upper member 201, and is received within threaded opening 212 in lower member 202. Upper member 201 includes a downwardly-opening hook-shaped extension 213 that fits over a beam 11 when the cover panel brace 200 is installed on the panel frame 2. Lower hook-shaped extension 214 permits lower member 202 to hang from a beam 11 for the lowest height panel frame 2.

Posts 6 may have different heights, such that the height of panel frame 2 varies. To accommodate variations in panel height, the cover panel brace 200 can be adjusted by inserting the tab 207 into the selected opening 209 to change the vertical length of cover panel brace 200 to correspond to the height of the panel frame 2. After the cover panel brace 200 is adjusted to the correct length, hook-shaped extension 213 is placed over a beam 11, such that the cover panel brace 200 hangs from the beam 11. The cover panels 4 are then installed over the cover brace 200, with the rear surface 215 of the cover panel brace 200 abutting the inner surface 217 of the cover panel 4. Brace 200 is installed between a pair of posts to prevent excessive flexing of a center portion 216 of a cover panel 4 if a force is applied to the outer surface of the cover panel 4. Cover panel brace 200 is useful for relatively narrow, elongated, or "segmented" cover panels 4

(FIG. 2), particularly when the posts 6 are spaced-apart for wider panels, such as 72 inch wide panels. Cover panel brace 200 maintains the alignment between cover panels 4 along the horizontal joint 159 between adjacent cover panels. Although light block 154 (FIG. 26) will prevent a gap at horizontal joint 159 if a force is applied to the upper cover panel, if a cover panel brace 200 is not used, a force applied to the lower cover panel will cause the lower cover panel to flex inwardly, creating a gap at joint 159. Cover panel brace 200 prevents this misalignment and resulting gap at horizontal joint 159. A data or power trough 30, 31 is located at a mid-panel height to provide additional stiffness. Cover panel brace 200 abuts the mid-height data or power trough, thereby preventing inward flexing of cover panel brace 200.

If cover panels 4 have a construction requiring a thinner brace 200, elongated sections 203 and 204 can be constructed to have a flat cross-sectional shape. Hook-shaped extensions 213 and 214 are eliminated in this embodiment, and fasteners 219 are received in clearance holes 218 to secure cover panel brace 200 to the sides of beams 11.

The knock-down portable partition system 1 of the present invention provides a flexible, easily shipped and assembled system having capability for handling a wide range of power and communications cabling needs. Panel frame 2 is simple and quickly assembled, yet provides sufficient structural strength for support of hang-on accessories such as binder bins 19, work surfaces 20, and lower file storage units 22. Each post utilizes a single foot for support, thereby simplifying the vertical adjustment of the panel frame 2. The beams 11 and the data and power troughs 30, 31 may be removed from between a pair of vertical posts while the adjacent panel frames 2 are in an assembled condition. Cover panels 4 are easily removed and installed and provide an acoustic, sound-absorbing layer.

It will become apparent to those skilled in the art that various modifications to the preferred embodiment of the invention as described herein can be made without departing from the spirit or scope of the invention as defined by the appended claims.

The invention claimed is:

1. A knock-down partition panel frame, comprising:

a pair of spaced apart generally upright posts, each having at least one receptacle defining a tapered surface;

at least one generally horizontal member extending between and interconnecting said posts, said horizontal member including fastenerless connectors at opposite ends thereof, each having at least one connecting element engaging said tapered surface to thereby securely interconnect said posts and said horizontal member to define a rigid partition frame having an interior space; and a cover panel secured to said partition frame and closing off at least a portion of said interior space.

2. The knock-down partition panel set forth in claim 1, wherein:

said horizontal member includes a pair of connecting elements at a first one of said opposite ends;

at least a selected one of said posts having a pair of receptacles, each having an inwardly tapering edge that provides for rigid connection of said horizontal member to said post as said horizontal member is shifted downwardly into an engaged position with said receptacle.

3. The knock-down partition panel set forth in claim 2, wherein:

each said receptacle includes a pair of inwardly tapering edges.

4. The knock-down partition panel set forth in claim 2, wherein:

said pair of connecting elements of said horizontal member are horizontally spaced apart and comprise a first pair of connecting elements at a first end of said horizontal member, said horizontal member including a second pair of connecting elements at a second end of said horizontal member having substantially the same configuration as said first pair of connecting elements.

5. The knock-down partition panel set forth in claim 4, wherein:

said horizontal member includes third and fourth pairs of connecting elements having substantially the same configuration as said first pair of connecting elements at opposite ends of said horizontal member.

6. The knock-down partition panel set forth in claim 2, including:

locking elements adjacent opposite ends of said horizontal member that can be positioned to engage said horizontal member and said posts, said locking elements substantially preventing vertical motion of said horizontal member relative to said posts to retain said horizontal member in said engaged position.

7. The knock-down partition panel set forth in claim 1, wherein:

said connecting element includes a horizontally extending portion having a free end portion that extends downwardly; and each of said posts define a vertical face, said receptacle comprising an opening through said vertical face, said free end portion received within said receptacle when assembled to interconnect said horizontal member with said post.

8. The knock-down partition panel set forth in claim 7, wherein:

said post has a tubular construction with a sidewall defining inner and outer surfaces;

said free end portion having an engagement surface that contacts said inner surface of said sidewall.

9. The knock-down partition panel set forth in claim 8, wherein:

said opening has a side surface that tapers inwardly.

10. A knock-down partition panel frame, comprising:

a pair of spaced apart generally upright posts, each having at least one receptacle defining a tapered surface;

at least one generally horizontal member extending between and interconnecting said posts, said horizontal member including fastenerless connectors at opposite ends thereof, each having at least one connecting element engaging said tapered surface to thereby securely interconnect said posts and said horizontal member to define a rigid partition frame.

11. The knock-down partition panel frame set forth in claim 10, wherein:

said horizontal member includes a pair of connecting elements at a first one of said opposite ends;

at least a selected one of said posts having a pair of receptacles, each having an inwardly tapering edge that provides for rigid connection of said horizontal member to said post as said horizontal member is shifted downwardly into an engaged position with said receptacle.

12. The knock-down partition panel frame set forth in claim 11, wherein:

each said receptacle includes a pair of inwardly tapering edges.

13. The knock-down partition panel frame set forth in claim 11, wherein:

said pair of connecting elements of said horizontal member are horizontally spaced apart and comprise a first pair of connecting elements at a first end of said horizontal member, said horizontal member including a second pair of connecting elements at a second end of said horizontal member having substantially the same configuration as said first pair of connecting elements.

14. The knock-down partition panel frame set forth in claim 13, wherein:

said horizontal member includes third and fourth pairs of connecting elements having substantially the same configuration as said first pair of connecting elements at opposite ends of said horizontal member.

15. The knock-down partition panel frame set forth in claim 11, including:

locking elements adjacent opposite ends of said horizontal member that can be positioned to engage said horizontal member and said posts, said locking elements substantially preventing vertical motion of said horizontal member relative to said posts to retain said horizontal member in said engaged position.

16. The knock-down partition panel frame set forth in claim 15, wherein:

said locking element is pivotably mounted on said horizontal member.

17. The knock-down partition panel frame set forth in claim 10, wherein:

said connecting element includes a horizontally extending portion having a free end portion that extends downwardly; and each of said posts define a vertical face, said receptacle comprising an opening through said vertical face, said free end portion received within said receptacle when assembled to interconnect said horizontal member with said post.

18. The knock-down partition panel frame set forth in claim 17, wherein:

said post has a tubular construction with a sidewall defining inner and outer surfaces;

said free end portion having an engagement surface that contacts said inner surface of said sidewall.

19. The knock-down partition panel frame set forth in claim 18, wherein:

said opening has a side surface that tapers inwardly.

20. A knock-down partition panel, comprising:

a pair of horizontally spaced apart upright posts, said posts having sidewalls defining an inner surface and forming a tubular construction having a quadrilateral cross sectional shape, each post having at least one rail connection opening through at least a selected one of said sidewalls;

a pair of horizontal rails extending between said posts, said rails having opposite ends with a connecting element extending horizontally through said rail connection openings and engaging said inner surface to interconnect said posts to define a panel frame, said rails being vertically spaced apart to define upper and lower rails; and an electrical power supply secured to said lower rail and extending horizontally along a lower portion of said panel frame, said electrical power supply including at least one horizontally extending power line, and at least one power outlet receptacle.

21. The knock-down partition panel set forth in claim 20, including:

lock members interconnecting said posts and rails and preventing vertical movement of said rails relative to said posts.

22. The knock-down partition panel set forth in claim 21, wherein:

said posts include lock openings through said sidewalls, said lock members extending through said lock openings.

23. The knock-down partition panel set forth in claim 22, wherein:

said lock members pivotably engage said rails adjacent opposite ends thereof.

24. The knock down partition panel set forth in claim 20, wherein:

said panel frame defines an interior space; and including:

a cover panel connected to said panel frame and closing off at least a portion of said interior space.

25. The knock down partition panel set forth in claim 20, including:

a utility trough having an upwardly opening U-shaped cross section extending between said posts, said utility trough having a sliding wedge mounted thereon, said sliding wedge adapted to engage a selected one of said posts to interconnect said utility trough and said selected one of said posts.

26. The knock-down partition panel set forth in claim 20, wherein:

said upper rail extends along an upper portion of said partition panel, said upper rail having a generally, U-shaped cross section to permit lay in of data lines along said upper portion of said partition panel.

27. The knock-down partition panel set forth in claim 26, wherein:

said posts have a cutout portion at the upper ends in alignment with said upper rails such that data lines can be routed uninterrupted through said cutout portion and along said upper rail.

28. The knock-down partition panel set forth in claim 27, including:

at least one cover panel secured to said panel frame and extending between said posts.

29. A knock-down partition panel, comprising:

a pair of horizontally spaced apart upright posts, said posts having sidewalls defining an inner surface and forming a tubular construction having a quadrilateral cross sectional shape, each post having at least one beam connection opening through at least a selected one of said sidewalls;

a pair of horizontal beams extending between said posts, said beams having opposite ends with a connecting element extending horizontally through said beam connection openings and engaging said inner surface to interconnect said posts to define a panel frame;

lock members interconnecting said posts and beams and preventing vertical movement of said beams relative to said posts;

said posts include lock openings through said sidewalls, said lock members extending through said lock openings; and wherein:

a side surface of said rail connection opening tapers inwardly to rigidly engage said connecting element.

* * * * *